US007237871B2

(12) United States Patent
Yamaguchi et al.

(10) Patent No.: US 7,237,871 B2
(45) Date of Patent: Jul. 3, 2007

(54) RECORDING APPARATUS AND RECORDING METHOD THEREOF, AND PROGRAM

(75) Inventors: Hiromitsu Yamaguchi, Yokohama (JP); Satoshi Wada, Tokyo (JP); Makoto Akahira, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 268 days.

(21) Appl. No.: 10/998,649

(22) Filed: Nov. 30, 2004

(65) Prior Publication Data

US 2005/0134617 A1 Jun. 23, 2005

(30) Foreign Application Priority Data

Dec. 3, 2003 (JP) ..... 2003-405129

(51) Int. Cl.
*B41J 2/155* (2006.01)

(52) U.S. Cl. ..... 347/42; 347/13; 347/5

(58) Field of Classification Search ..... 347/5, 347/12, 19, 42, 40, 13
See application file for complete search history.

(56) References Cited

U.S. PATENT DOCUMENTS

| | | | | |
|---|---|---|---|---|
| 6,598,951 | B2 | 7/2003 | Ikemoto et al. | 347/13 |
| 2002/0057309 | A1 * | 5/2002 | Ikemoto et al. | 347/42 |

FOREIGN PATENT DOCUMENTS

| | | |
|---|---|---|
| EP | 0 914 950 | 5/1999 |
| JP | 6-255098 | 9/1994 |
| JP | 11-198380 | 7/1999 |
| JP | 2980429 | 9/1999 |
| JP | 2000-190484 | 7/2000 |
| JP | 2001-1510 | 1/2001 |
| JP | 2001-199074 | 7/2001 |

* cited by examiner

*Primary Examiner*—Lam Nguyen
(74) *Attorney, Agent, or Firm*—Fitzpatrick, Cella, Harper & Scinto

(57) ABSTRACT

Printed pages of a stably high image quality can be produced when performing printing using a recording apparatus having an elongate joint head. The recording apparatus determines whether an end of an image to be printed is included in a joint of overlapping chips. If the end of the image is included in the joint, the recording apparatus sets groups of nozzles to be used so as to use, of nozzles corresponding to the chip joint (overlapping nozzles), continuously all nozzles included in the group of nozzles of a chip, of which nozzles other than the overlapping nozzles are used.

2 Claims, 26 Drawing Sheets

| FIG.7A |
| --- |
| FIG.7B |

RECORDING APPARATUS AND RECORDING METHOD THEREOF, AND PROGRAM

BACKGROUND OF THE INVENTION

1. Field of the Invention

The present invention generally relates to a recording apparatus related to an ink jet recording apparatus using an elongate head having an array of a number of nozzles extending over a relatively long range, or what is called a full multi-head (also called as a full line head) having an array of a number of nozzles extending over a range corresponding to a length along a width of recording paper, a recording method thereof, and a program. More specifically, the present invention relates an ink jet recording apparatus using, as the full multi-head, an elongate print head, or what is called a joint head, in which a plurality of relatively short chips, each having a plurality of nozzles, are arranged so as to be accurately joined together, a recording method thereof, and a program.

2. Description of the Related Art

Various types of recording apparatuses are available. Some of them are used for printers, copying machines, and the like. Others may be used as output devices for multi-functional equipment including computers and word processors, and for workstations. Each of these different types of recording apparatuses is designed to print an image (including characters and symbols) on a recording medium that may be paper, a thin sheet of plastic, or the like, based on print information. Such recording apparatuses may be classified into an ink jet type, a wire dot type, a thermal type, a laser beam type, and the like according to a printing method employed.

A serial type recording apparatus is known. The serial type apparatus performs a print action through a scanning motion in a direction (a main scanning direction) perpendicular to a direction (a sub scanning direction) of transport of a recording medium. In such a recording apparatus, print means (a print head) traveling along the recording medium forms the image. Each time a print action for one scanning motion is completed, the recording apparatus transports the recording medium a predetermined amount. The recording apparatus then performs a new print action in the subsequent scanning motion for the recording medium that has thereafter been brought to another stop. By repeating a sequence of these actions, the recording apparatus produces a printed output for the entire area of the recording medium.

Another type of the recording apparatus, a line printer (also called as a full line type) is available. A print action involved with the line printer is a motion in the sub scanning direction, or the direction of transport of the recording medium. Such a type of recording apparatus produces a printed output for the entire area of the recording medium as follows. Specifically, the recording medium is loaded at a prescribed position and, while a print action for each entire line of the image is carried out continuously, the recording medium is transported a predetermined amount.

Of the various types of recording apparatuses described in the foregoing, the ink jet type recording apparatus (the ink jet recording apparatus) carries out a print action by expelling ink from print means or the print head relative to the recording medium. The ink jet recording apparatus offers a number of benefits as detailed in the following. Specifically, it is easy to build the print head compact; an image of high resolution can be formed at high speed; a running cost is low, since the method requires no special treatment on plain paper; noise is low because the action is a non-impact type; it is easy to configure a structure for forming a color image by using ink of different colors; and the like.

One known type of the ink jet recording apparatus attracts attention as a printer for on-demand printing, of which there is lately a growing need. Specifically, this type of ink jet recording apparatus is of line printer configuration. The apparatus uses what is called the full multi-type print head formed by an array of a number of ink jet recording elements (nozzles, ink ejection ports) arranged in a direction perpendicular to the direction of transport of the recording medium. The apparatus permits image formation performed at even higher speed.

A print speed on the order of 100,000 printed pages per hour, as in printing of conventional newspapers and magazines in units of several million copies, is not required of on-demand printing. Rather, labor saving is at a premium in on-demand printing. Though inferior in print speed to conventional offset printing machines or the like, the full multi-head line printer eliminates the need for making printing plates. Because of this labor saving feature, the full multi-head line printer is just right for on-demand printing.

A capability of producing 30 or more printed pages of A3 recording medium with a specific resolution of 600×600 dpi (dots/inch) for text and mono-color originals and of 1200×1200 dpi or higher for full-color originals, such as photos, is required of the full multi-head line printer used for the on-demand printing. Needs also exist, on the other hand, for producing an output of an image shot by a digital camera or the like on a conventional L-format size and on a small-sized medium, such as a postcard or the like. The full multi-head line printer may therefore be said to be used in a number of cases, in which printing involves recording media of several different sizes.

A major problem with the full multi-head printer was, however, difficulty involved in machining with no defects the entire ink jet recording elements (nozzles) provided over an entire width of a print area. For a full multi-head printer producing a printed output of a photo grade on large-sized paper, including reference materials produced for office use, for example, it is required that the printer be capable of producing the output onto recording paper of A3 size. This requires a full multi-head having a recording width of about 280 mm. To print on A3 size paper at 1200 dpi, therefore, it becomes necessary to provide about 14,000 nozzles for a single full multi-head for recording the image of one color. Because of manufacturing processes involved, it is extremely difficult to machine the entire ink jet recording elements corresponding to this large number of nozzles with no defects allowed whatsoever. Should it be possible to machine the elements properly, a conformance rate must be very low with an exorbitant amount of cost involved in manufacturing.

A known ink jet recording apparatus of the line printer configuration using the full multi-head therefore employs what is called a joint head to achieve the intended purpose. The joint head specifically refers to a print head that is an array of a plurality of relatively inexpensive, short-length chips (a group of nozzles) used in the serial type arranged accurately to make an elongate print head.

Benefits of using the joint head include: a reduced manufacturing cost thanks to an improved manufacturing yield rate; the maximum print width of the print head can be changed relatively easily according to the number of short-length chips placed.

There is, however, a problem about the joint head, in which an image quality at a joint between chips tends to be degraded because of a structure of the joint head involved. Specifically, deviation produced in the arrangement of the chips causes a nozzle pitch between adjacent nozzles at the joint to change relative to a nozzle pitch between adjacent nozzles at portions other than the joint. This results, in many cases, in a joint line occurring at a portion of the image produced corresponding to the joint.

As noted earlier, the joint head is an array of a plurality of short-length chips, each having an arbitrary number of nozzles. It is therefore easy to configure print heads of varying print widths by simply changing the number of chips placed. On the other hand, it is difficult to construct a print head having a width equivalent to the print width required for printing of the recording medium (ordinary standard sizes). A common approach is therefore to construct a print head such that the width of the print head is wider than the maximum width of the recording medium. This is accomplished by increasing the number of chips placed. This, in turn, means that there is a group of nozzles that are not to be used.

Various solutions have so far been proposed to these problems relating to the joint head. First, the following approaches are proposed for the solutions to the joint line. The approaches are intended for enhancing physical machining accuracy of the head: specifically, for example, a method of accurately arranging chips at the joint with a high chip arrangement accuracy; and an arrangement apparatus used to minimize deviation in nozzle pitch.

Another proposed method is to arrange chips such that several nozzles at ends of different chips overlap each other, instead of placing an end nozzle of one chip adjacent to an end nozzle of another chip at the joint. According to this method, ink is ejected from the two mutually overlapping nozzles during printing. The image is thereby processed so as to make the joint line less noticeable. Still another proposed method is to vary the amount of ink drops ejected from the nozzles of the joint of the chips, thereby making the joint less noticeable.

A solution is proposed to the problem of disposition of groups of non-use nozzles arising from a difference between the recordable width of the print head and the maximum width of the recording medium. This difference in width is produced due to two or more chips arranged, each having an arbitrary number of nozzles. The proposed solution is to configure the non-use nozzles as ejection-disabled nozzles by leaving them disconnected from a circuit concerned. A further approach is proposed to use part of the ejection-disabled nozzles as ejection-enabled ones in terms also of circuit configuration, if heads are disposed in the printer so that the chip joint is varied for each color. This approach is to prevent the image from being degraded by the joint.

A number of patent documents disclose techniques relating to the joint head as described heretofore. Examples of such patent documents include Japanese Patent No. 2980429, Japanese Patent Application Laid-Open No. 6-255098(1994), Japanese Patent Application Laid-Open No. 11-198380(1999), Japanese Patent Application Laid-Open No. 2001-001510, and Japanese Patent Application Laid-Open No. 2001-199074.

It is, however, considered that the solutions proposed in these patent documents are not effective enough to solve the problem of degraded image quality at the chip joints throughout the entire image area, in printing the image on recording media of varying sizes using the joint head. The conventional techniques are yet to be improved in that uneven streaks and moiré that are particularly noticeable in ends of the image tend to occur if the ends of the image are included in the chip joint. The problematic symptoms are particularly noticeable when printing is made through overlapping of chip joints.

SUMMARY OF THE INVENTION

In view of the foregoing problems in the conventional art, it is an object of the present invention to provide a recording apparatus, a recording method thereof, and a program capable of performing printing of stably high quality at all times when printing on recording media of various sizes using an elongate joint head.

To achieve the foregoing object, in an aspect of the present invention, a recording apparatus has a print head (a joint head) formed by an array of a plurality of chips, each chip having a plurality of recording elements for recording an image arranged in a first direction, the print head being arranged in the first direction so as to have an overlap portion or a joint portion, in which adjacent chips overlap for a predetermined number of recording elements, and records, while transporting a recording medium in a second direction perpendicular to the first direction, an image to be recorded on the recording medium by driving the recording elements of the print head based on print data corresponding to the image to be recorded. The recording apparatus includes: first determination means for determining whether or not an end of the image to be recorded is included in the overlap portion; and first control means for controlling, if a determination that the end is included in the overlap portion is made by the first determination means, so as to use only one of the chips overlapping at the overlap portion for recording the image.

The recording apparatus according to the present invention is an ink jet recording apparatus. The print head of the ink jet recording apparatus is an elongate one which is an array of a plurality of short-length chips arranged in a direction (a nozzle train direction) different from a scanning direction of the recording medium. Each of the short-length chips includes a group of nozzles arranged in a direction different from a scanning direction of the recording medium relative to the print head. The ink jet recording apparatus lets this elongate print head eject ink drops through the nozzles by scanning the recording medium relative to the print head. The print head has a structure, in which at least one nozzle or more are overlapped. If an end area of an image to be printed is included in the overlap portion of a portion of joining chips of the elongate print head, only one group of nozzles of the overlap portion is used for printing.

To achieve the foregoing object, in another aspect of the present invention, a recording method uses a print head formed by an array of a plurality of chips, each chip having a plurality of recording elements for recording an image arranged in a first direction, the print head being arranged in the first direction so as to have an overlap portion, in which adjacent chips overlap for a predetermined number of recording elements, for recording, while transporting a recording medium in a second direction perpendicular to the first direction, an image to be recorded on the recording medium by driving the recording elements of the print head based on print data corresponding to the image to be recorded. The recording method includes: a first determination step for determining whether or not an end of the image to be recorded is included in the overlap portion; and a first control step for controlling, if a determination that the end is included in the overlap portion is made in the first determination step, so as to use only one of the chips overlapping at the overlap portion for recording the image.

To achieve the foregoing object, in still another aspect of the present invention, a computer program product causes a computer to execute a recording method that uses a print head formed by an array of a plurality of chips, each chip having a plurality of recording elements for recording an image arranged in a first direction, the print head being arranged in the first direction so as to have an overlap portion, in which adjacent chips overlap for a predetermined number of recording elements, for recording, while transporting a recording medium in a second direction perpendicular to the first direction, an image to be recorded on the recording medium by driving the recording elements of the print head based on print data corresponding to the image to be recorded. The computer program product includes; first program code means for determining whether or not an end of the image to be recorded is included in the overlap portion; and second program code means for controlling, if a determination that the end is included in the overlap portion is made by the first program code means, so as to use only one of the chips overlapping at the overlap portion for recording the image.

Through the arrangements as described in the foregoing, the recording apparatus uses the elongate joint head formed by an array of the plurality of chips (group of nozzles), each chip having a plurality of ink jet recording elements (nozzles), arranged in a direction different from the scanning direction in which the recording medium is scanned. When printing an image on the recording medium of various sizes, the recording apparatus ensures that, if the end of the image to be printed is included in the chip joint, only one of the two chips included in the joint is used and not the other, according to the size of the print image.

For the purpose of this specification, "to print" refers to forming an image, a mark, a pattern, or the like on a recording medium, or processing a medium, regardless of whether the information to be "printed," including text and graphics, is significant or insignificant, or whether the information be actual so as to be perceived by humans.

The "recording medium" refers to not only paper used in the ordinary ink jet recording apparatus, but also a cloth, plastic film, a metal, or any other object capable of receiving ink ejected by the head.

The "ink" should also be broadly interpreted as with "to print" described above. The "ink" refers to a liquid applied to a recording medium for forming an image, a mark, a pattern, or the like thereon, or used for processing the recording medium.

According to the present invention, uneven streaks and uneven moiré that are particularly noticeable in ends of the image of the print data can be inhibited from occurring, yielding an effect of producing an output of stably high quality.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
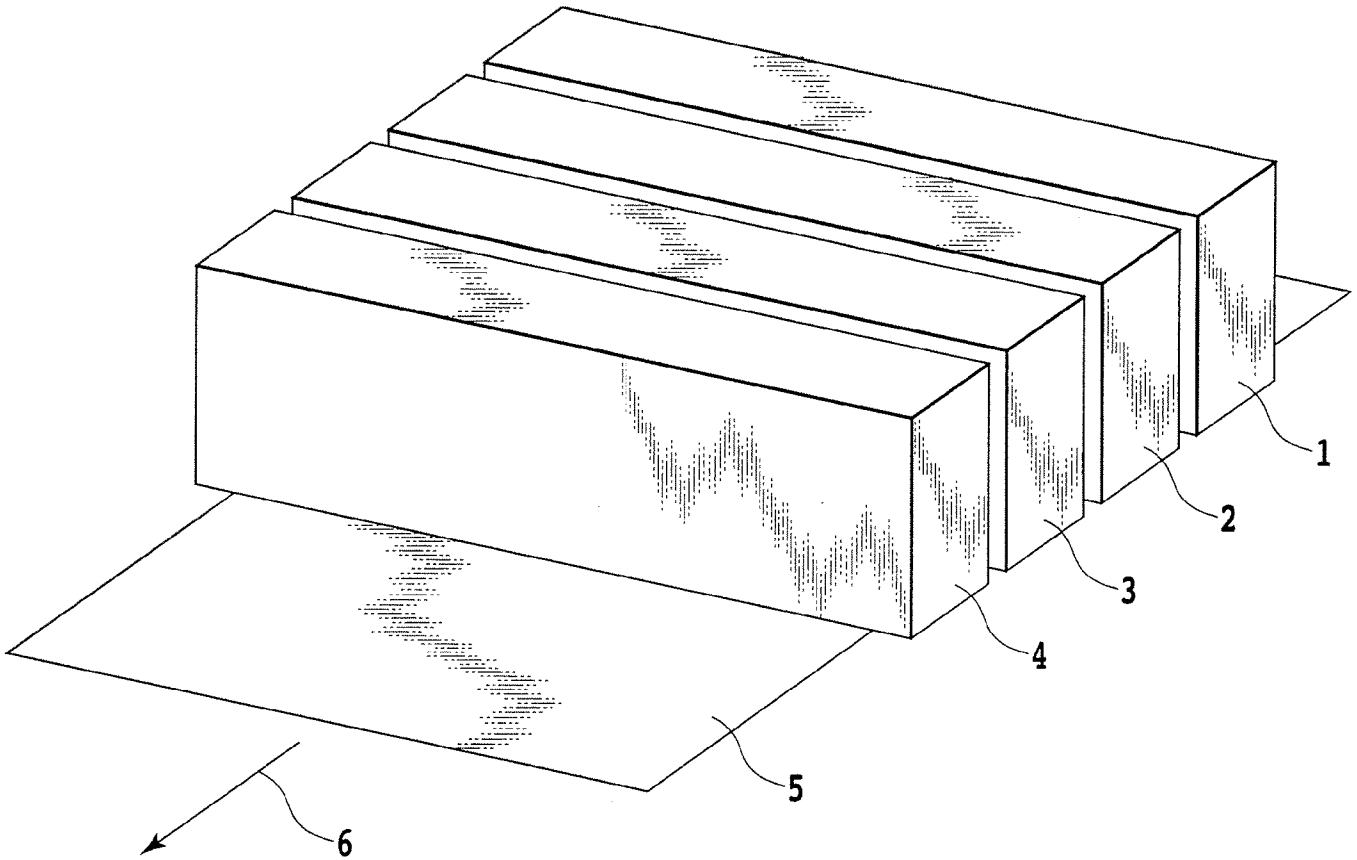
FIG. 1 is a view showing schematically an ink jet recording apparatus according to a preferred embodiment of the present invention.

Preferred embodiments of the present invention will be described in detail with reference to the accompanying drawings. In each of the accompanying drawings, like parts are identified by the same reference numerals with explanations thereof being omitted.

(Apparatus Structure)

FIG. 1 is a view showing schematically an ink jet recording apparatus according to a preferred embodiment of the present invention. A head unit includes a plurality of elongate ink jet print heads 1 to 4. Each of the plurality of elongate ink jet print heads 1 to 4 includes an away of nozzles for ejecting ink. The ink jet print heads 1, 2, 3, and 4 are elongate print heads for ejecting ink of black (K), ink of cyan (C), ink of magenta (M), and ink of yellow (Y), respectively. Each of the print heads is connected to an ink supplying tube (not shown). Further, a control signal or the like is transmitted to each of the print heads over a flexible cable (not shown).

A recording medium 5 is supported by being sandwiched between transport rollers (not shown). The recording medium 5 may be plain paper, high grade paper, OHP (overhead projector) transparencies, glossy paper, glossy film, postcards, or the like. The recording medium 5 is fed in an arrow direction 6 (a main scanning direction of a line type recording apparatus according to the preferred embodiment of the present invention; corresponds to a sub scanning direction in a serial type recording apparatus) as driven by a transport motor. A heat generating element (an electrothermal energy converter) for generating thermal energy for ejecting ink is provided in an inside (a liquid path) of a nozzle of the ink jet heads 1 to 4. In time with reading taken by a linear encoder (not shown), the heat generating element is energized based on a recording signal. Drops of ink are thereby landed on and stuck onto the recording medium to form an image.

The ink jet print head uses capping means (not shown) to seal a nozzle forming surface when recording is not done. The capping means prevents ink from being firmly fixed as a result of an ink solvent having been vaporized and the nozzles from being blocked due to dust or other foreign objects sticking thereto.

A capping function of the capping means is also used for other purposes. Specifically, the capping function is used for idle or dummy ejection, in which ink is ejected toward a cap portion which is away from the nozzle. This is done to solve the problem of an ejection failure or clogging of a nozzle having a low recording frequency. The capping function is also used for a recovery operation performed for a nozzle that has developed an ejection failure. The recovery operation specifically sucks up ink from the defective nozzle by actuating a pump (not shown) with the cap in place. A blade or wiping member may also be disposed at an area adjacent to the cap portion, thereby enabling cleaning of the nozzle forming surface of the ink jet head.

Figure 2:
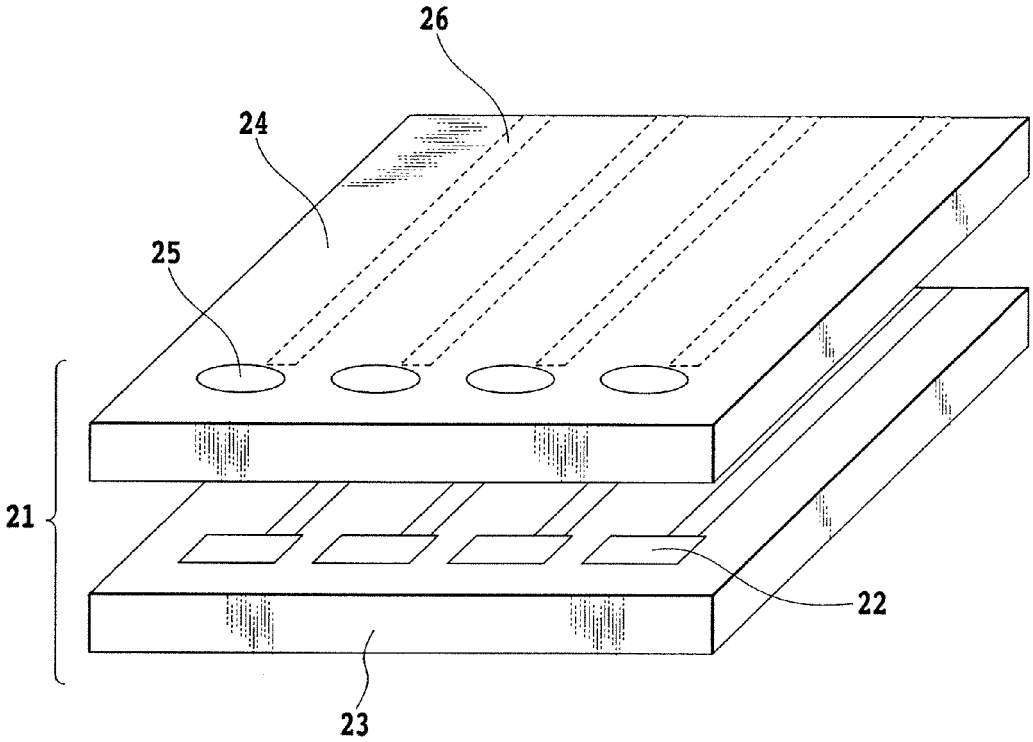
FIG. 2 is a view showing schematically a structure of part of a print head of the ink jet recording apparatus according to a preferred embodiment of the present invention.

FIG. 2 schematically shows a structure of part of the ink jet print head described above. Referring to FIG. 2, an ink jet head 21 includes a heater board 23 and a top panel 24. The heater board 23 is a board on which a plurality of heaters 22 for heating ink are formed. The top panel 24 is placed over and thus covers the heater board 23. A plurality of nozzles 25 are formed in the top panel 24. A tunnel-shaped liquid path 26 is formed in the rear of each of the nozzles 25. The liquid path 26 communicates with the nozzle 25. Each of the liquid paths 26 is commonly connected to a single ink liquid chamber in the rear thereof. Ink is supplied to the ink liquid chamber via an ink supplying port. The ink is then supplied to each of the liquid paths 26 from the ink liquid chamber. The heater board 23 and the top panel 24 are positioned correctly into an assembled state as shown in FIG. 2 such that each of the heaters 22 is located at the corresponding liquid path 26.

FIG. 2 shows only four heaters 22. One heater 22 is disposed at each of the liquid paths 26. When a prescribed driving pulse is supplied to the heater 22 in the assembled state as shown in FIG. 2, ink on the heater 22 boils to form bubbles. A cubical expansion of the bubbles pushes and ejects ink from the nozzle 25. It should be noted that the ink jet recording method applicable to the present invention is not limited to the Bubble Jet (BJ)® system using the heating element (heater) as shown in FIGS. 1 and 2. The present invention is applicable, for example, to a continuous control type, a dissipation control type, or the like, if the system is a continuous type, in which drops of ink are continuously ejected and changed into particles. With an on-demand type, in which drops of ink are ejected on demand, the present invention may be applicable to a pressure control type or the like, in which drops of ink are ejected from an orifice through mechanical vibrations of a piezoelectric oscillating element.

Figure 3:
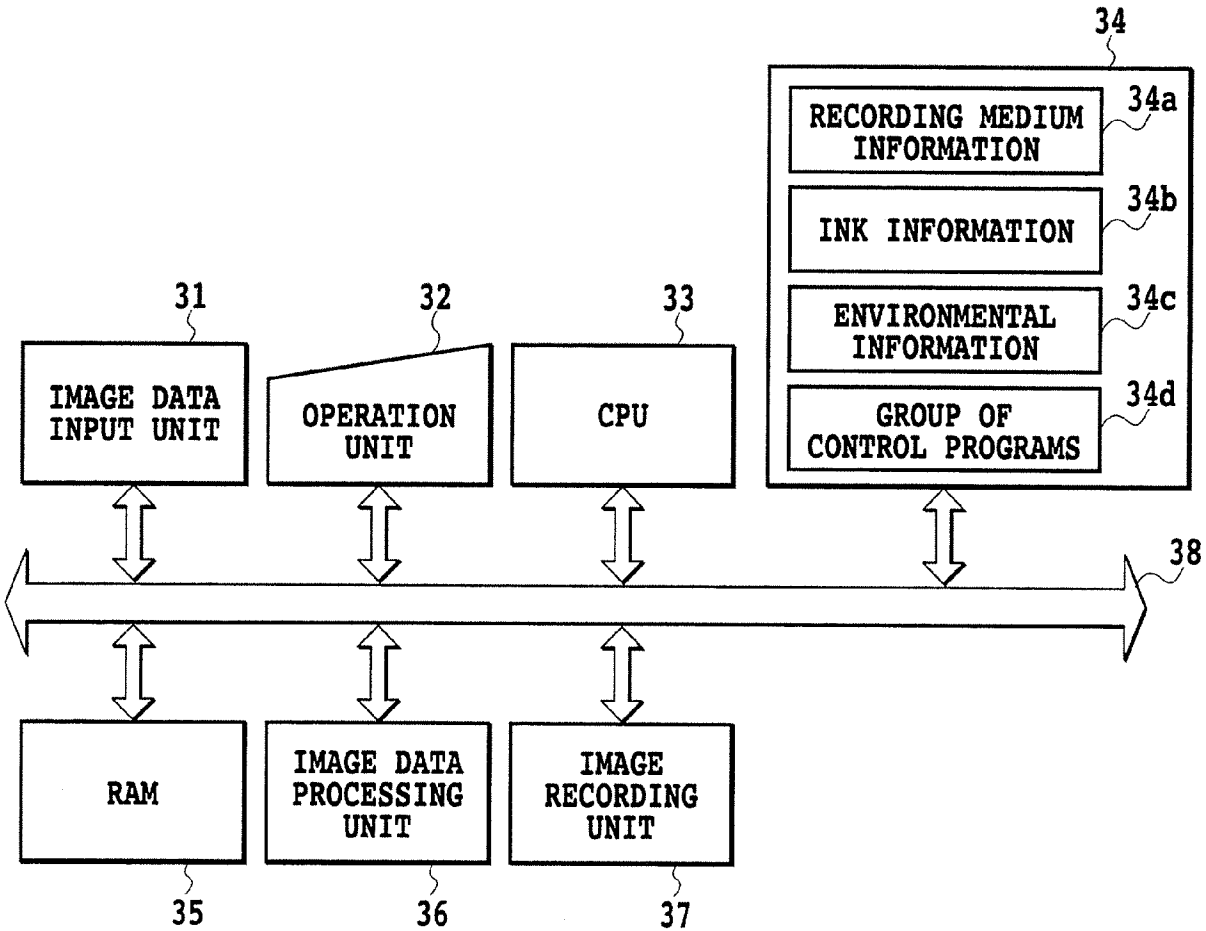
FIG. 3 is a block diagram showing a configuration of a control system for the ink jet recording apparatus according to a preferred embodiment of the present invention.

FIG. 3 is a block diagram showing a configuration of a typical control system for the ink jet recording apparatus according to the preferred embodiment of the present invention. Referring to FIG. 3, a reference numeral 31 represents an image data input unit. A reference numeral 32 represents a control unit. A reference numeral 33 represents a CPU (central processing unit) for performing various operations. A reference numeral 34 represents a storage medium. A reference numeral 34*a* represents information on mainly types of the recording media. A reference numeral 34*b* represents information on ink used for printing. A reference numeral 34*c* represents information on environment during printing, such as temperature and humidity. A reference numeral 34*d* represents control programs of various sorts. Further, a reference numeral 35 represents RAM (random access memory). A reference numeral 36 represents an image data processing unit. A reference numeral 37 represents an image recording unit for producing an output of the image. A reference numeral 38 represents a bus for transferring data of various sorts.

Described in detail, the image data input unit 31 inputs multivalued image data from a scanner, a digital camera, or other image input device and multivalued image data saved in a hard disk or the like of a personal computer. The control unit 32 includes various types of keys for setting parameters and commanding the start of a print cycle. The CPU 33 controls the entire ink jet recording apparatus according to the preferred embodiment of the present invention according to the programs resident in the storage medium 34. The storage medium 34 stores a program and the like for operating the ink jet recording apparatus according to the preferred embodiment of the present invention according to a control program and an error processing program. This program defines all operations performed by the ink jet recording apparatus according to the preferred embodiment of the present invention.

For the storage medium 34 for storing the program, ROM (read only memory), a FD (floppy® disk), a CD (compact disc [disk])-ROM, a HD (hard disk), a memory card, an optical magnetic disk, or the like may be used. The RAM 35 is used as a work area for the various types of programs stored in the storage medium 34, a temporary buffer area for error processing, and a work area for image processing. The RAM 35 can also be used for performing image processing by referring to a table which is created by copying and then modifying as necessary tables of various types stored in the storage medium 34.

The image data processing unit 36 quantizes the multivalued image data input thereto to N-ary image data for each pixel. The image data processing unit 36 then prepares print data of an ejection pattern corresponding to a tone value "K" representing each of the quantized pixels. Specifically, the image data processing unit 36 converts the multivalued image data input thereto to corresponding N-ary image data and then creates the ejection pattern corresponding to the tone value "K." Suppose, for example, that multivalued image data represented in 8 bits (256 tonal levels) is input to the image data input unit 31. It then becomes necessary for the image data processing unit 36 to convert the tone value of the image data to be output to a 25(=24+1)-ary value. Herein, a multilevel error diffusion method is used for converting the input halftone image data to the corresponding K-ary data. It should, however, be noted that the method employed is not limited to the multilevel error diffusion method. Rather, any halftone processing method, such as an average density retention method, a dither matrix method, and the like, may be used. The process of converting the image data to the corresponding K-ary data based on density information of the image is repeated to cover all pixels. A binary driving signal, either ejection or non-ejection, is thereby formed for each pixel for each of all nozzles.

The image recording unit 37 includes the print head described earlier with reference to FIG. 1. Based on the print data of the ejection pattern prepared by the image data processing unit 36, the image recording unit 37 ejects ink to form a dot image on the print medium. The bus 38 is a bus line over which an address signal, data, a control signal, and the like for the ink jet recording apparatus according to the preferred embodiment of the present invention are transmitted.

Printing that forms a characteristic part of the preferred embodiment of the present invention will be described with reference to FIGS. 4 through 12. Creation of the print data will first be explained. The print data processed by using the print head according to the preferred embodiment of the present invention is prepared by using common techniques generally used by the ordinary ink jet recording apparatus, such as the processes performed by the image data processing unit 36 described above. In accordance with the preferred embodiment of the present invention, the image data processing unit 36 separates the multivalued image data input thereto into corresponding multivalued color data corresponding to the head of each color. The error diffusion method is then employed to convert this corresponding multivalued color data to corresponding binary data. Print data ("print data" as the terms used herein refers to binary color data indicating either ejection or non-ejection of ink) to be printed by the print head of each of different colors is thereby prepared.

Figure 4:
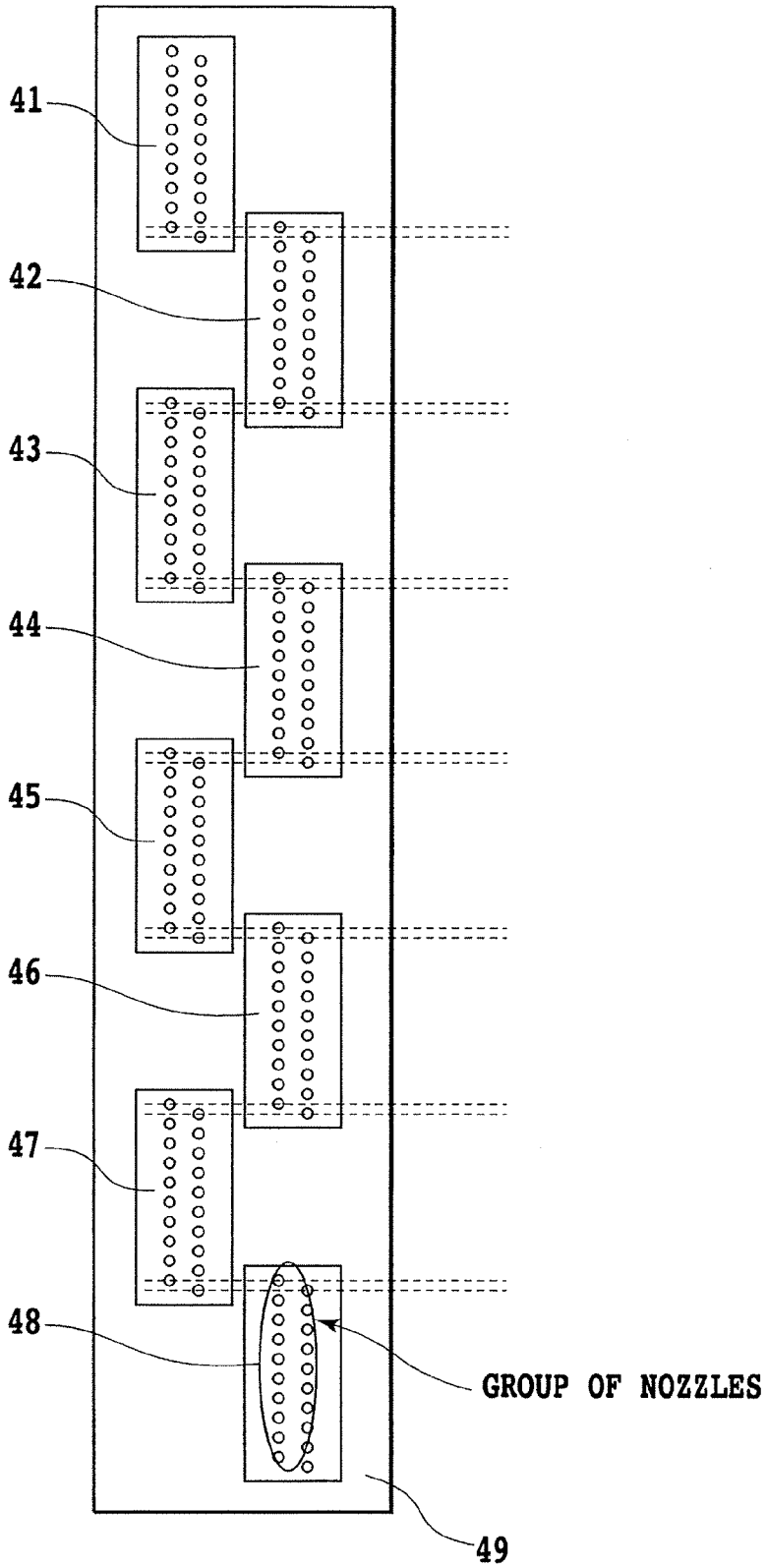
FIG. 4 is a view showing schematically a layout of a plurality of groups of nozzles in a full multi-type elongate print head according to a preferred embodiment of the present invention.
Figure 5:
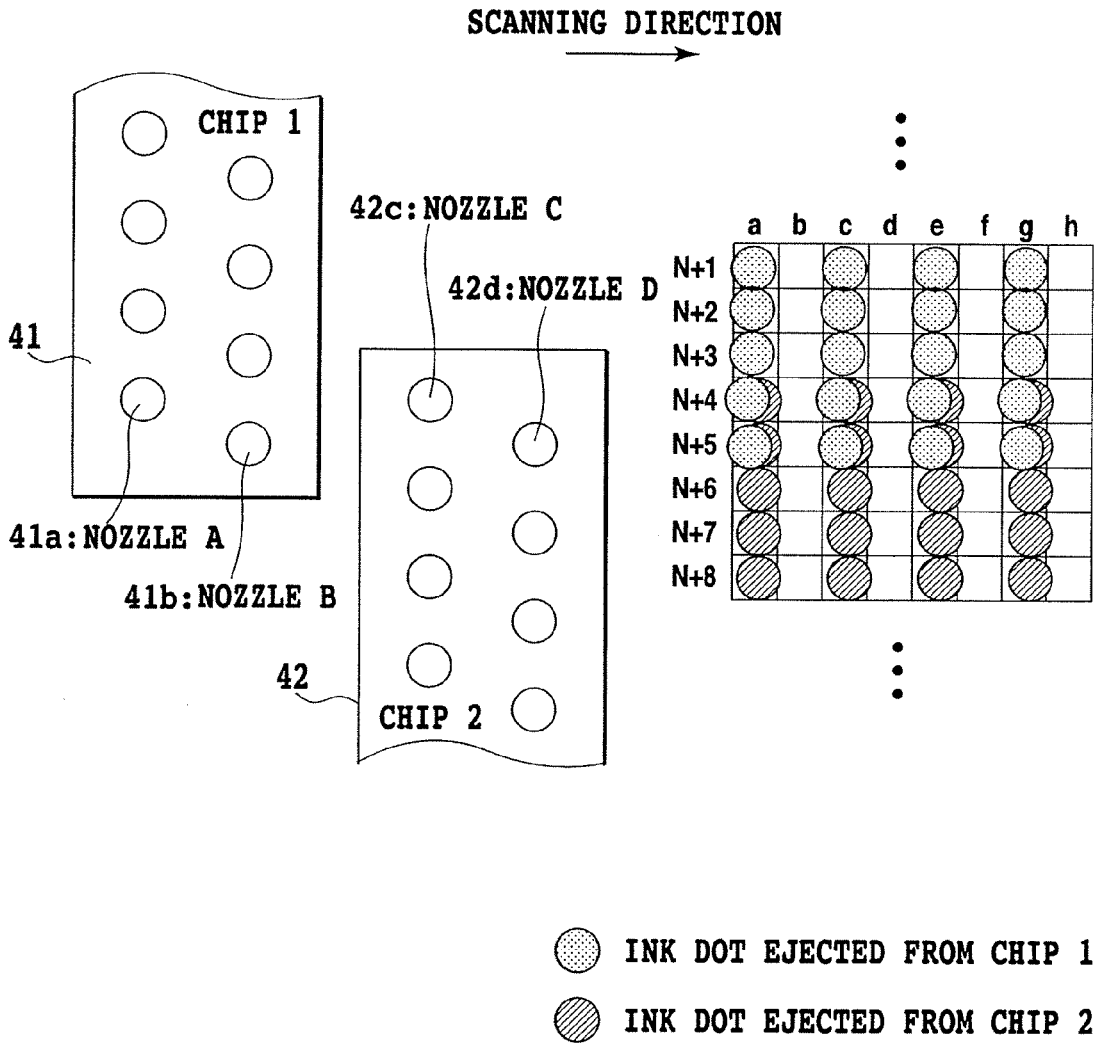
FIG. 5 is a view showing schematically a layout of adjacent chips and a layout of ink dots ejected by nozzles in a chip joint in the full multi-type elongate print head according to a preferred embodiment of the present invention.

The full multi-type elongate print head according to the preferred embodiment of the present invention will be described. FIG. 4 is a view showing schematically a layout of a plurality of groups of nozzles in the full multi-type elongate print head as applied to the print heads 1 to 4 shown in FIG. 1 according to the preferred embodiment of the present invention. FIG. 4 shows a full multi-type elongate print head 49 that is configured as follows. Specifically, a plurality of (eight for the print head shown in FIG. 4) chips 41 to 48, each having a relatively short group of nozzles (a small number of nozzles), are disposed in a staggered fashion in the nozzle train direction to form a single elongate print head.

When the short chips 41 to 48 are laid out in the staggered fashion as shown in FIG. 4, end nozzles of groups of nozzles should have the following mutual relation. Specifically, at least two or more nozzles should overlap each other (two nozzles in the case of FIG. 4). These nozzles are disposed such that drops of ink ejected from the overlapping nozzles land within the same recording matrix when the print head performs printing through scanning relative to the recording medium.

In detail, the groups of nozzles are disposed as follows. Specifically, referring to FIG. 5, an ink dot ejected from a nozzle A 41*a* of a chip 1 having a reference numeral 41 and an ink dot ejected from a nozzle C 42*c* of a chip 2 having a reference numeral 42 land in (N+4, a), (N+4, c), (N+4, e), and (N+4, g) on the recording matrix during the same scanning sequence. Similarly, an ink dot ejected from a nozzle B 41*b* of the chip 1 having the reference numeral 41 and an ink dot ejected from a nozzle D 42*d* of the chip 2 having the reference numeral 42 land in (N+5, a), (N+5, c), (N+5, e), and (N+5, g) on the recording matrix during the same scanning sequence.

Figure 6:
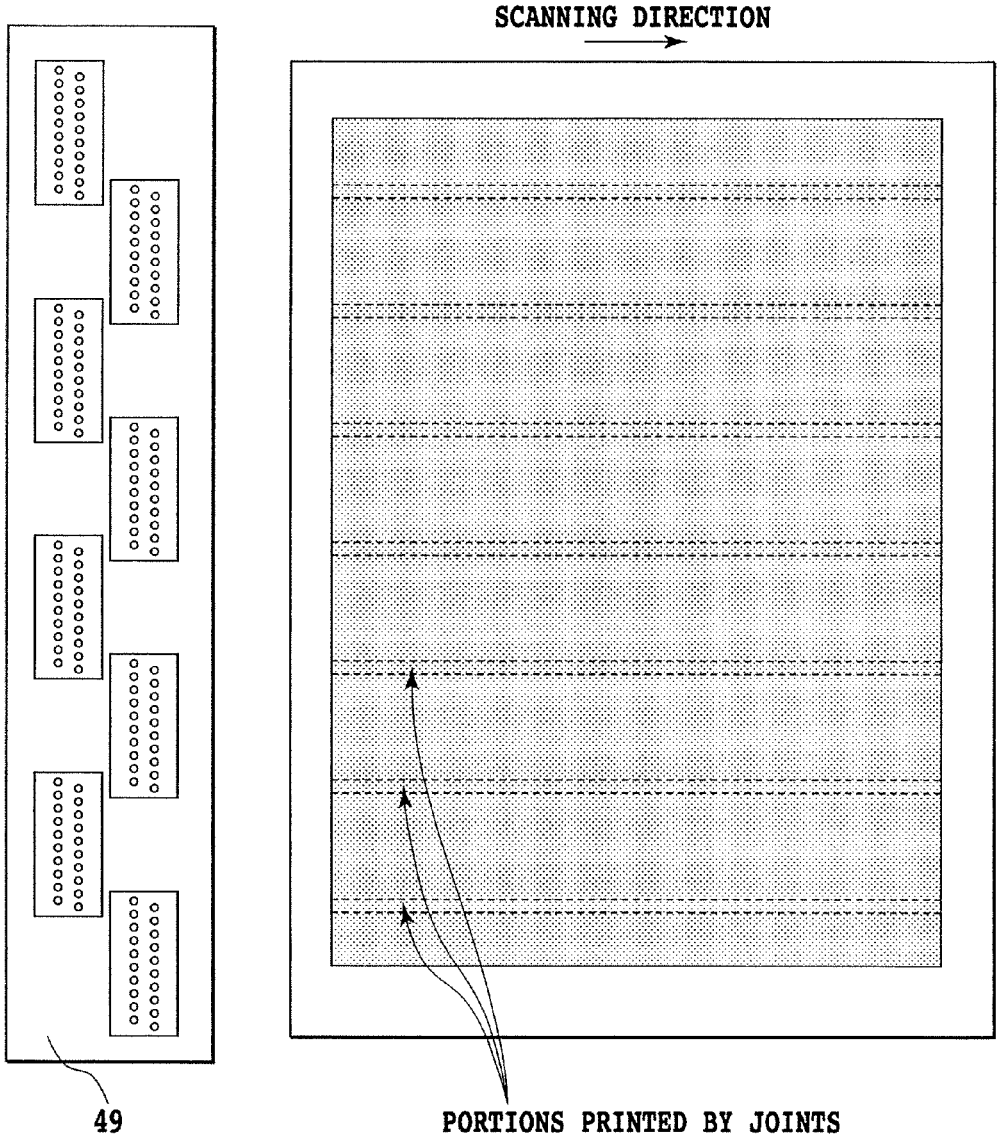
FIG. 6 is a view showing schematically a print data image formed using the elongate print head according to a preferred embodiment of the present invention.

FIG. 6 is a view showing schematically a print image formed through a single scanning sequence using the elongate print head 49 according to the preferred embodiment of the present invention. FIG. 6 shows that there are portions (seven in the case of FIG. 6) corresponding to the joint of chips evident within the printed image.

(Description of Operation)

A printing method that forms a characteristic part of the preferred embodiment of the present invention will be described in detail in the configuration of the apparatus as described in the foregoing.

Figures 7, 7A:
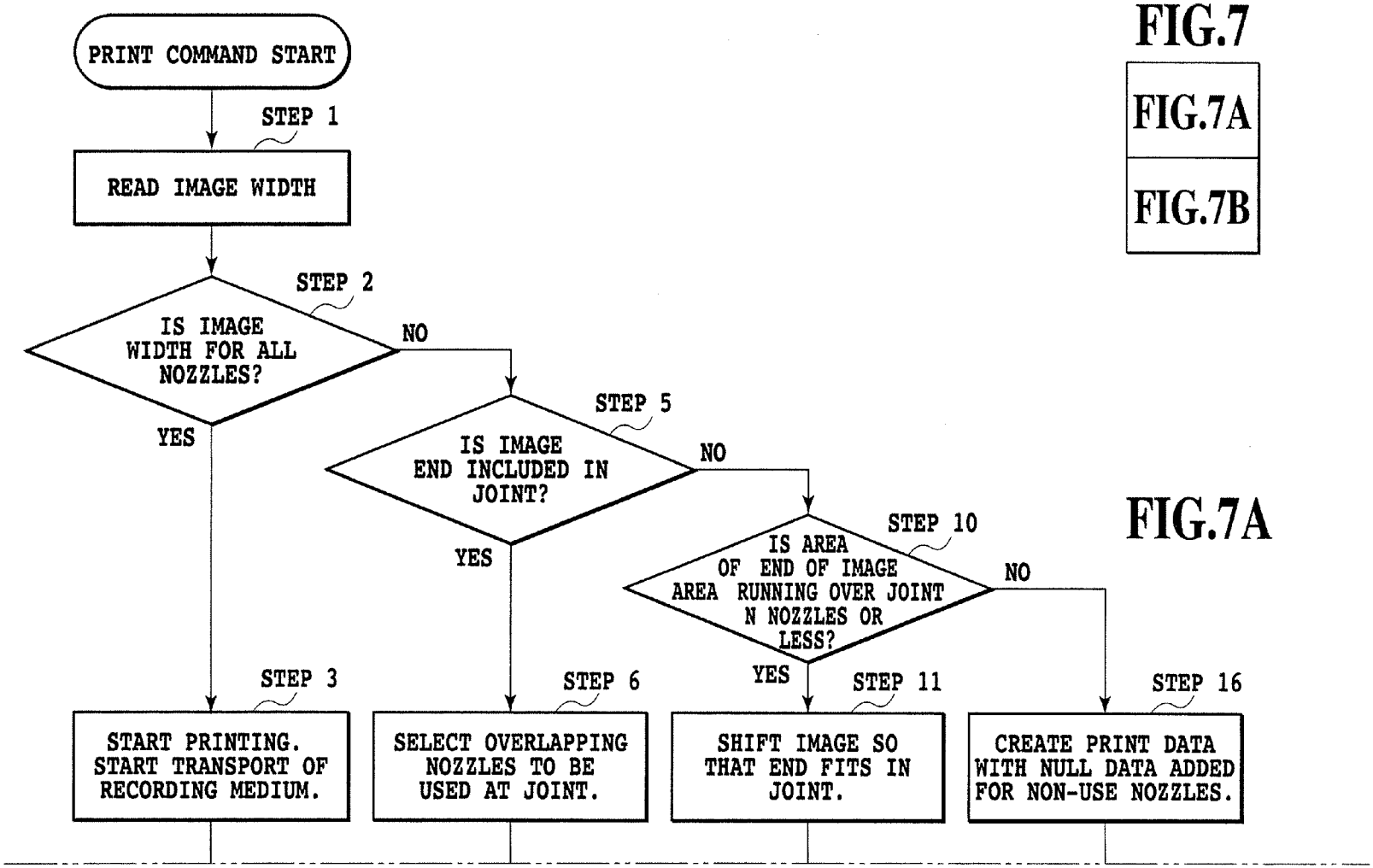
FIG. 7 is a flowchart showing the relationship of FIGS. 7A and 7B.
FIG. 7A is a flowchart showing print processes performed by the elongate print head according to a preferred embodiment of the present invention.
Figure 7B:
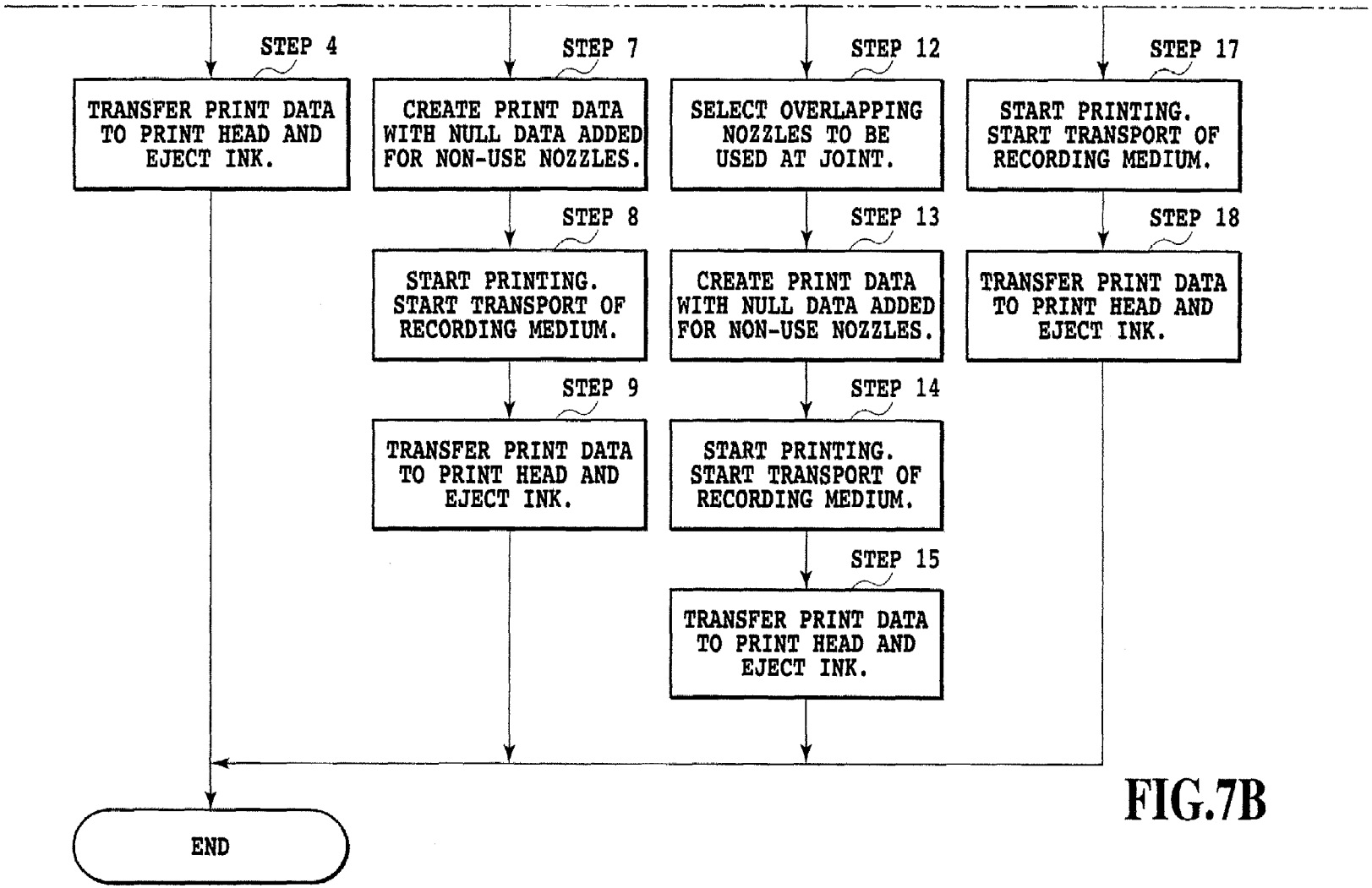
FIG. 7B is a flowchart showing print processes performed by the elongate print head according to a preferred embodiment of the present invention.

FIGS. 7A and 7B are flowcharts showing control procedures performed by the CPU 33 for positions of the nozzles used. Processing steps shown in FIGS. 7A and 7B represent specific controls executed by the CPU 33 for positioning the nozzles used. The steps are executed by the CPU 33 reading the program stored in the storage medium 34.

When a print command is issued, the CPU 33 reads a width of the image to be printed (hereinafter referred to as a "pixel width") in step 1. Herein, the image width is the width of print data in a direction perpendicular to the direction of transport of the recording medium (i.e., the nozzle train direction).

The size of the recording medium may be handled as a print data width (image width). For example, to print the image to cover the entire recording medium, a so-called standard size of the recording medium can be handled as the print data width. If the size of the recording medium is unknown, an arrangement is made to detect the width of the recording medium using a well-known detecting mechanism. The detected width may then be handled as the print data width. That is, the print data width is handled as being adjusted to match the size of the recording medium used.

In step 2, the CPU 33 determines whether or not the image width reading taken corresponds to all nozzles. Specifically, it is determined whether the print data is to be printed using all groups of nozzles of the print head or any arbitrary part of groups of nozzles of all.

If it is determined that the print data is to be printed using all groups of nozzles, then the CPU 33 determines that the operation proceeds to step 3. If it is determined that the print data is to be printed using only arbitrary part of groups of nozzles of all (that is, the image width is narrower than the width corresponding to the entire nozzles of the print head), the CPU 33 determines that the operation should proceed to step 5. An operation performed in each of these steps will be explained in detail.

Figure 8:
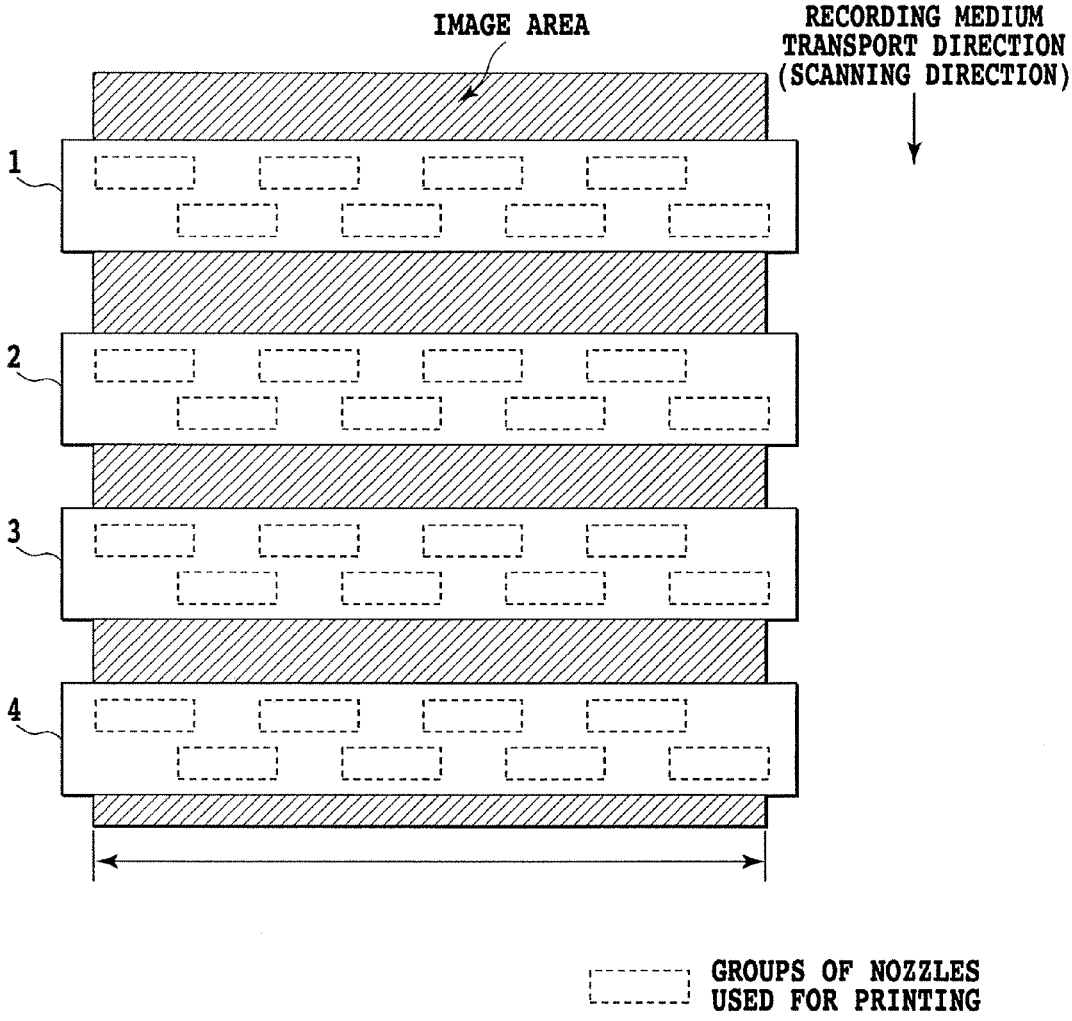
FIG. 8 is a view showing schematically a print data image formed by using all nozzles of the print head in the print processes according to a preferred embodiment of the present invention.
Figure 9:
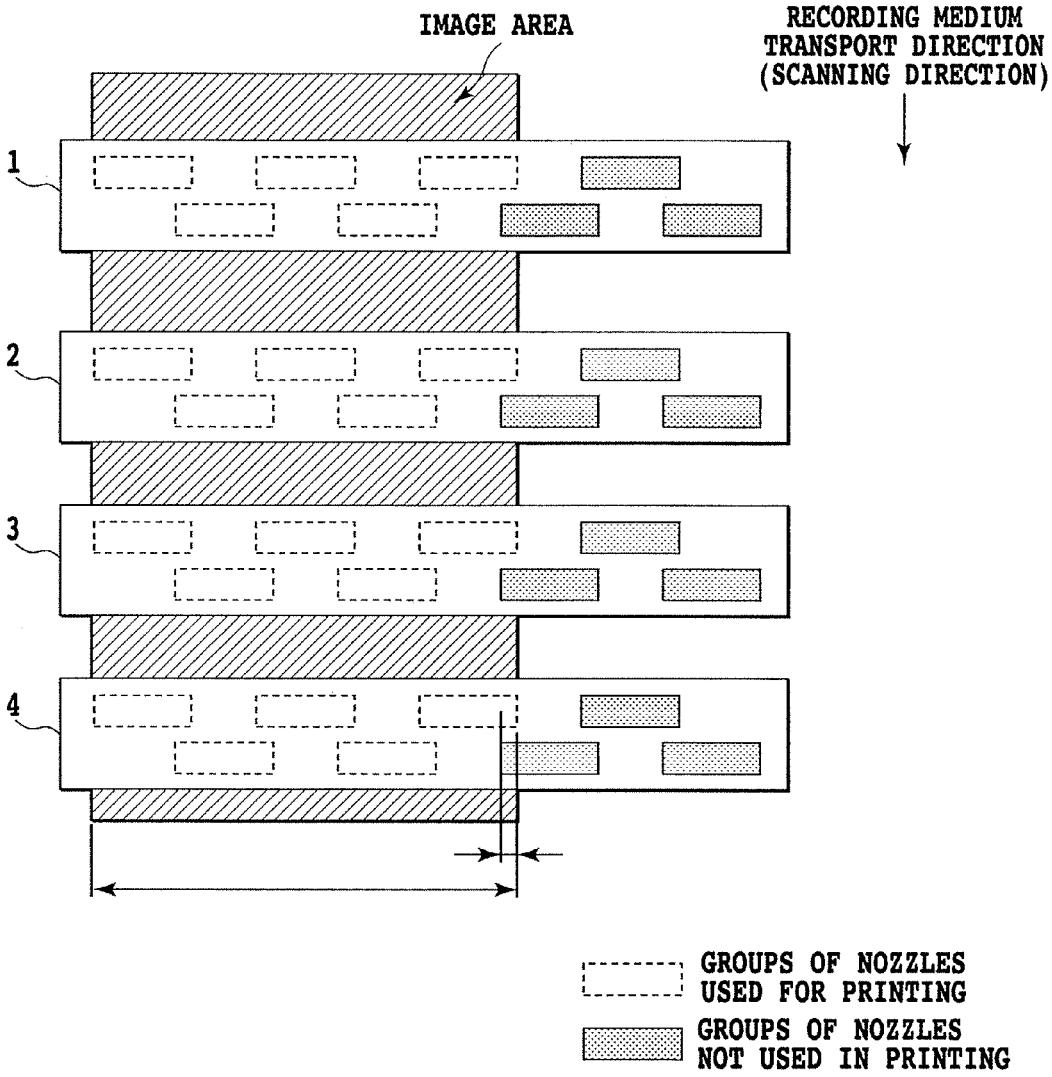
FIG. 9 is a view showing positions of nozzles used relative to a print data image area after the nozzles used of a chip joint have been selected when an end of a print area is included in an overlap area of the chip joint in the print processes according to a preferred embodiment of the present invention.
Figure 10:
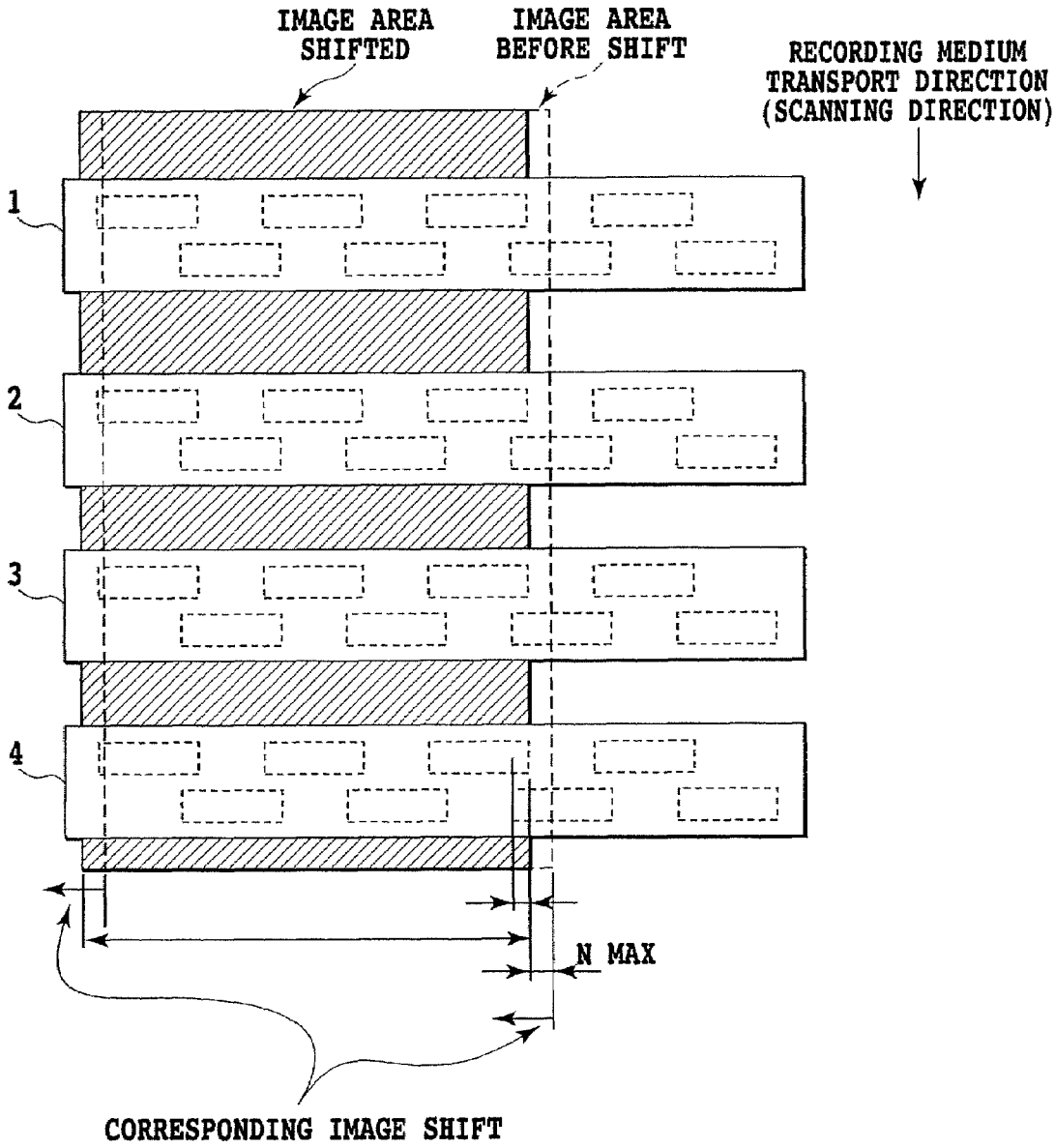
FIG. 10 is a view showing positions of the nozzles relative to the print data image area after, when the end of the print area runs over the overlap area of the chip joint, the print data image area has been shifted such that an end of an excess area running over the overlap area falls within the overlap, in the print processes according to a preferred embodiment of the present invention.

In step 3, the CPU 33 directly starts the print cycle. FIG. 8 is a view showing schematically a method of forming the image to be printed in steps 3 and 4. The CPU 33 uses a transport belt to start transporting the recording medium at a desired speed.

In addition, when the print head reaches a point in the recording medium, at which printing is to be started (a print start position), the CPU 33 drives each of the nozzles based on a recording signal corresponding to the print data in time with reading taken by a linear encoder (not shown). The CPU 33 thereby ejects drops of ink onto the recording medium to form the image (in step 4).

In step 5, the CPU 33 determines the specific groups of nozzles of the print head to be used according to the image width reading taken in step 1. The CPU 33 determines whether or not the end of the image area, of the image width reading taken, is included in the overlap area of the chip joint. If the end of the image area is included in the overlap area of the chip joint, the CPU 33 causes the operation to proceed to step 6. If the end of the image area is not included in the overlap area of the chip joint, on the other hand, the CPU 33 then causes the operation to proceed to step 10.

In step 6, the CPU 33 sets groups of nozzles to be used as follows. Specifically, of the overlapping nozzles at the chip joint, the CPU 33 sets to use continuously all nozzles included in the group of nozzles of a chip, of which nozzles other than the overlapping nozzles are used. This results in the positional relation between the image area and the nozzles used shown in FIG. 9. Herein, there are naturally produced groups of nozzles that are not to be used.

In step 7, the CPU 33 adds a null part to the print data so as to transfer null image data, thereby inhibiting the groups of nozzles not to be used from ejecting ink. The CPU 33 thereafter starts transporting of the recording medium at the desired speed (in step 8). When the print head reaches the print start position in the recording medium, the CPU 33 controls so that drops of ink ejected from the print head land on the recording medium, thereby forming the image based on the print data (in step 9).

In step 10, the CPU 33 determines the size of an area of the end of the image area that does not fit in the overlap area. Specifically, the CPU 33 determines whether the area of the end of the image area that runs over the overlap area is N (N is any arbitrary integer) number of nozzles or more. If the area of the end of the image area running over the overlap area is N (e.g., 2) nozzles or less, the CPU 33 causes the operation to proceed to step 11. If, on the other hand, the area of the end of the image area running over the overlap area exceeds N nozzles, the CPU 33 causes the operation to proceed to step 16.

Figure 11:
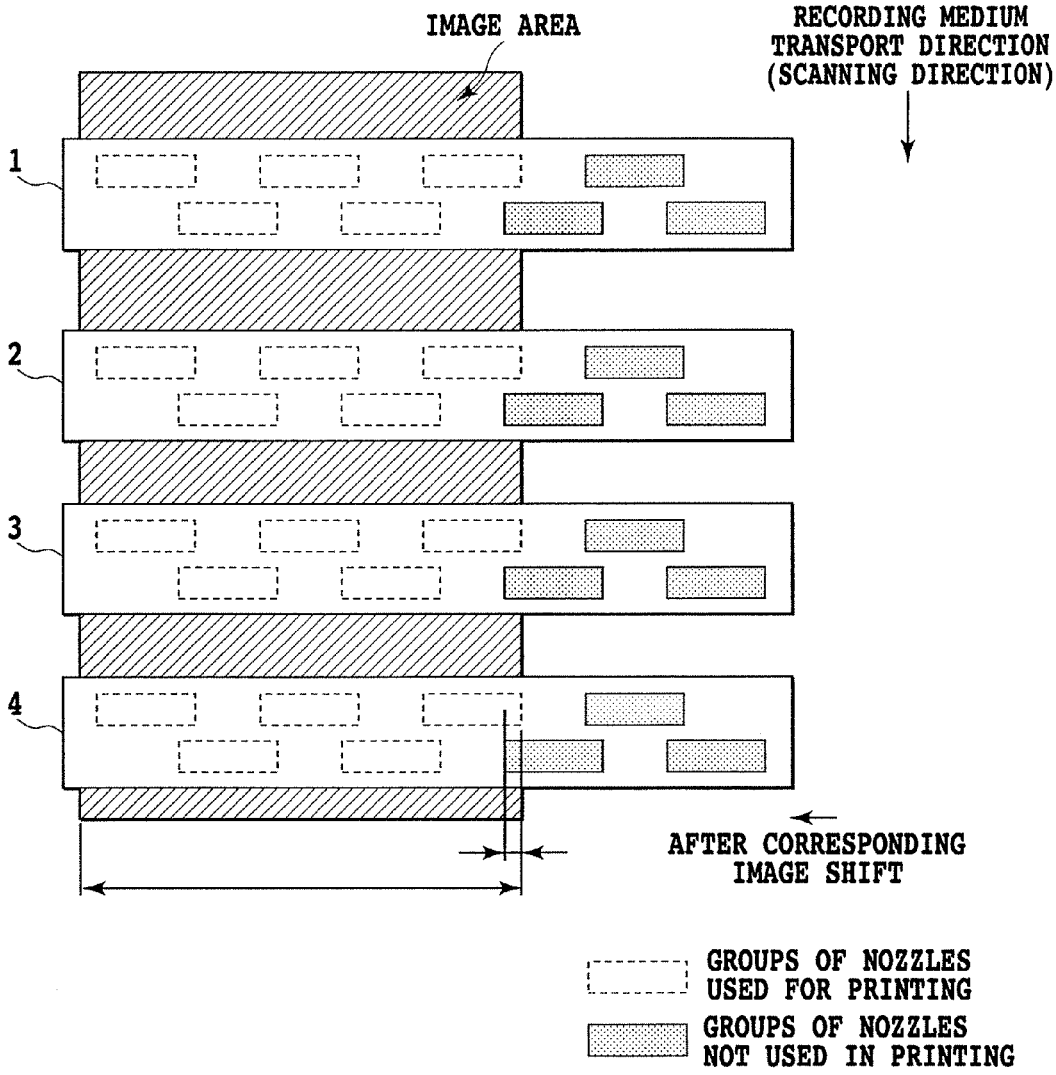
FIG. 11 is a view showing positions of the nozzles used relative to the print data image area after the nozzles used of the chip joint have been selected based on the positions of the nozzles relative to the print data image area and a width of the print data image determined in FIG. 10 according to a preferred embodiment of the present invention.

In step 11, the CPU 33 shifts the print data for the size of the area running over the overlap area. Specifically, the CPU 33 shifts the print data such that the end position of the image area is offset N (e.g., 2) nozzles toward the overlap area (in step 10). Herein, as in step 6, the CPU 33 sets, of the overlapping nozzles at the chip joint, to use continuously all nozzles included in the group of nozzles of a chip, of which nozzles other than the overlapping nozzles are used (in step 12). At this time, the relation between the image area to be printed and the positions of the nozzles used is as shown in FIG. 11.

Further in step 13, as in step 7, the CPU 33 adds a null part to the print data so as to transfer null image data, thereby inhibiting the groups of nozzles not to be used from ejecting ink. The CPU 33 thereafter starts transporting of the recording medium at the desired speed (in step 14). When the print head reaches the print start position in the recording medium, the CPU 33 controls so that drops of ink ejected from the print head land on the recording medium, thereby forming the image (in step 15).

Figure 12:
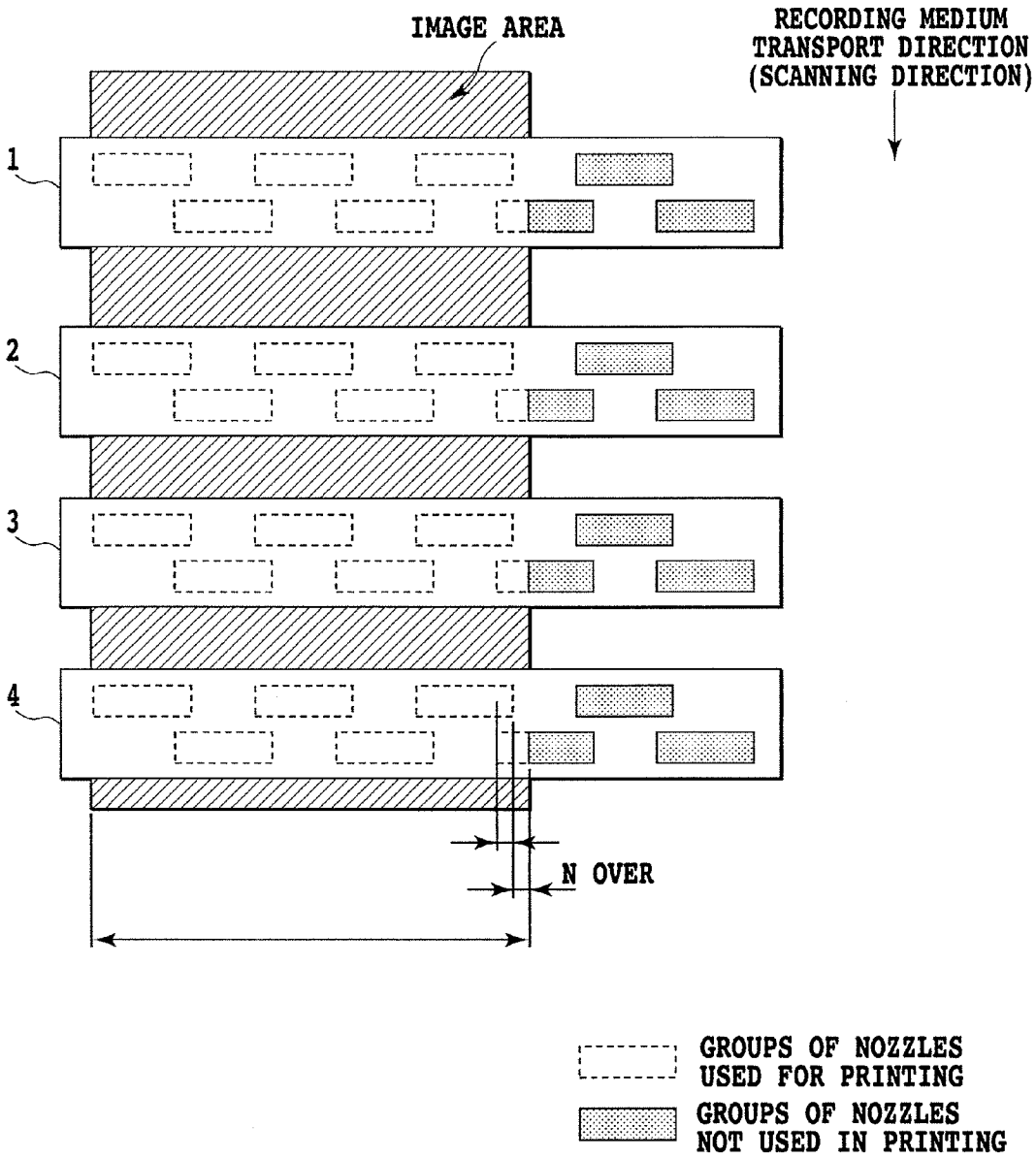
FIG. 12 is a view showing positions of the nozzles used relative to the print data image area after the nozzles used have been selected without performing any additional corrective step when the end of the print area runs over the overlap area of the chip joint in the print processes according to a preferred embodiment of the present invention.

In step 16, the CPU 33 adds a null part to the print data so as to transfer null image data, thereby inhibiting the groups of nozzles not to be used for printing from ejecting ink. FIG. 12 shows the relation between the image area to be printed and the positions of the nozzles used at this time. The CPU 33 thereafter starts transporting of the recording medium at the desired speed (in step 17). When the print head reaches the print start position in the recording medium, the CPU 33 controls so that drops of ink ejected from the print head land on the recording medium, thereby forming the image (in step 18).

No visually noticeable degraded image quality was found in the end of the image area of a printed sample produced through these steps. Further, no degraded image quality was noticed in the end of the image area of additional printed samples produced repeatedly thereafter.

In accordance with the preferred embodiment of the present invention, the following method is employed if there are groups of nozzles that are not to be used according to the width of the image to be printed. Specifically, null data is added to the print data so as to inhibit the groups of nozzles not to be used for printing from ejecting ink during printing. The processing for inhibiting ejection of ink during printing is not, however, limited the method described above. As the method for inhibiting the non-use nozzles from ejecting ink, one possible method is, for example, to set for a pulse width to be applied a value brief enough to prevent ejection of the ink. Another possible method is not to apply the pulse at all. Still another possible method is to set for a driving voltage to be applied to the non-use nozzles a value small enough to prevent ejection of the ink, or even not to apply the driving voltage at all.

In the preferred embodiment of the present invention, the amount N corresponding to the area of the end of the image area running over the overlap area corresponding to the chip joint is two nozzles. The number of nozzles is not, however, limited to two. It is preferable that an optimum value be set according to the image to be actually printed.

For example, if there is no blank space, or what is called margin, existing in the end of the image to be printed as exemplified in the preferred embodiment of the present invention, the permissible amount of shift is one nozzle or more and less than N nozzles (N being an integer). This is obviously true when considering the quality of the image to be formed. Further, if there is what is called the margin existing in the end of the image to be printed, it becomes possible to shift the print data for the number of nozzles corresponding to the margin. The permissible amount of shift can therefore be set to the number of nozzles corresponding to the margin or less. In either case, no problem is presented as long as recording is done without allowing the quality of the image actually formed to be degraded.

The preferred embodiment of the present invention described in the foregoing concerns a case where the present invention is applied to a recording apparatus of the ink jet type. A recording apparatus employing the wire dot system, the thermal system, or other system is nonetheless effective in terms of degraded image quality involving lines and uneven image occurring from an error in arrangement of the ink jet recording elements because of the configuration of the ink jet recording elements involved. A print head of the wire dot system, the thermal system, or other system may therefore be used, alternatively.

The preferred embodiment of the present invention produces a favorable effect in the recording apparatus using, in particular, an ink jet recording head performing recording by forming flying liquid droplets using thermal energy, among other types of ink jet recording system.

EMBODIMENT 1

Embodiment 1 of the present invention using the ink jet recording apparatus explained in the foregoing with reference to the accompanying drawings will be described in detail. In each of the accompanying drawings, like parts are identified by the same reference numerals with explanations thereof being omitted.

Figure 13:
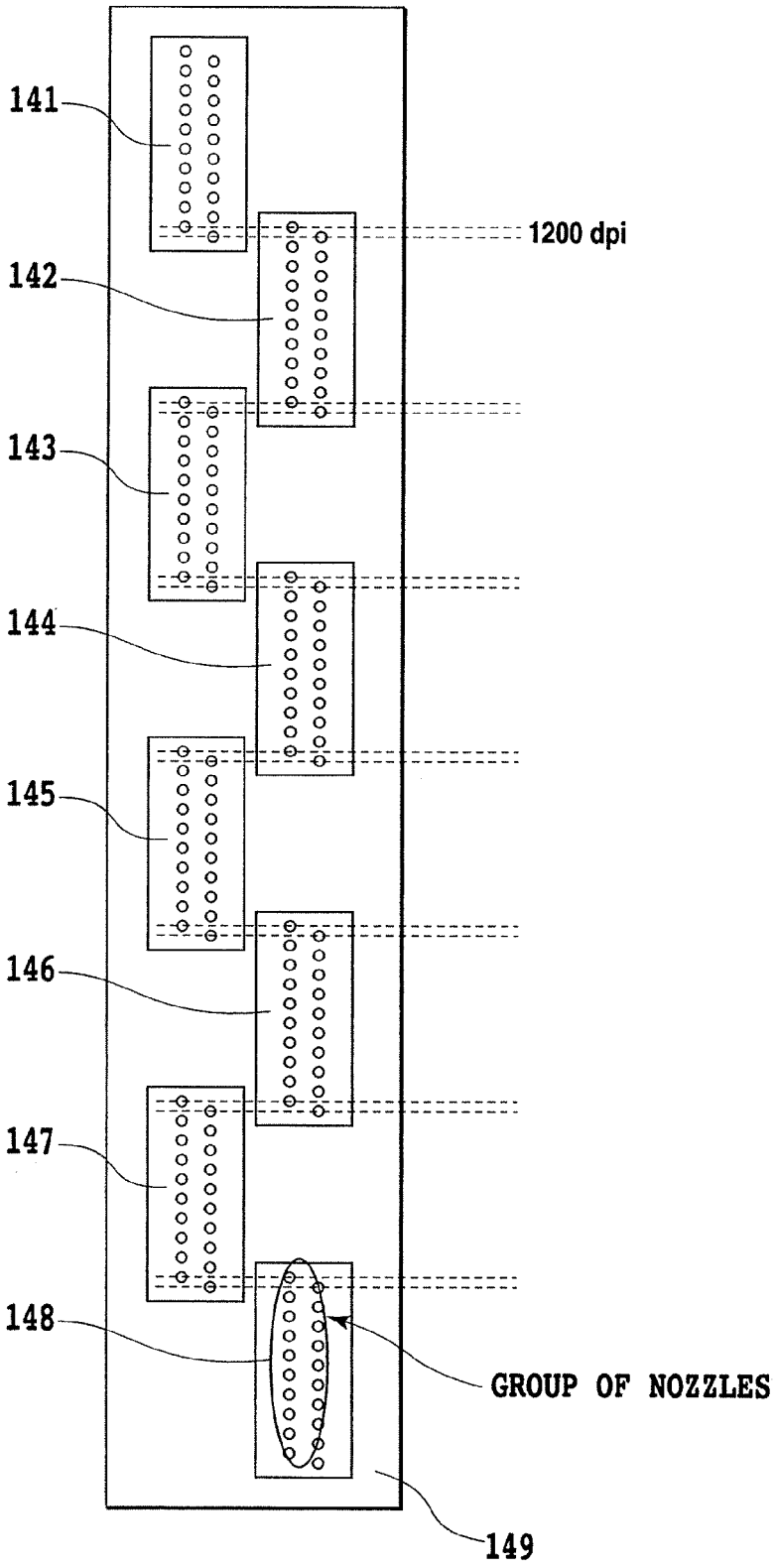
FIG. 13 is a view showing schematically a structure of an elongate print head according to first to third preferred embodiments of the present invention.

A print head 149 as shown in FIG. 13 is prepared for the elongate print head in the ink jet recording apparatus according to the aforementioned embodiment of the present invention used in Embodiment 1. The print head 149 includes eight chips 141 to 148, each having a group of nozzles, arranged as shown in FIG. 13. Each group of nozzles includes 1280 nozzles arranged at intervals of 1200 dpi (about 21.2 μm). The print head 149 thus has a total of 10,240 nozzles (1280×8). In addition, these eight chips are laid out such that two nozzles overlap at each joint between a corresponding pair of chips. An effective print nozzle width is therefore 10,226 nozzles (=10,240−2×7). The nozzles in each chip are divided into two driving blocks for each pair of nozzles. A block 1 and a block 2 are sequentially driven to eject drops of ink.

Figure 14:
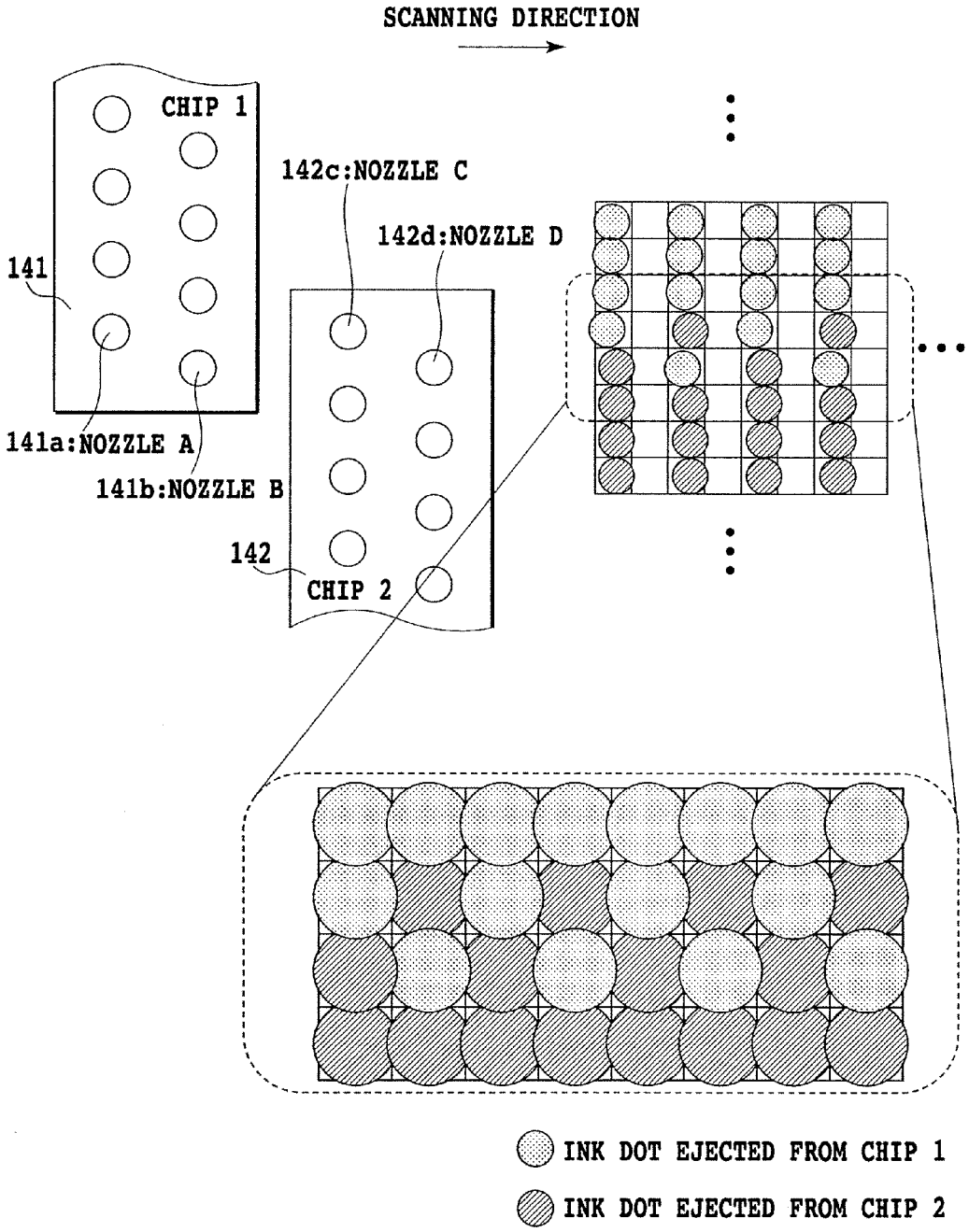
FIG. 14 is a view showing schematically a condition of ink dots ejected from each of nozzles in the chip joint of the elongate print head according to the first to the third preferred embodiments of the present invention.

The nozzles in the overlap portion are set so that an ejection distribution at each of the chips is 1 to 1 (that is, ink is ejected alternately) as shown in FIG. 14. Further, ejection timing of the entire chips is relatively adjusted in advance so that a layout pitch between chips relative to the main scanning direction is adjusted to ensure landing of dots on the same row. This enables line formation of a high print quality when a line pattern. Such as ruled lines and the like, is recorded.

Figure 15:
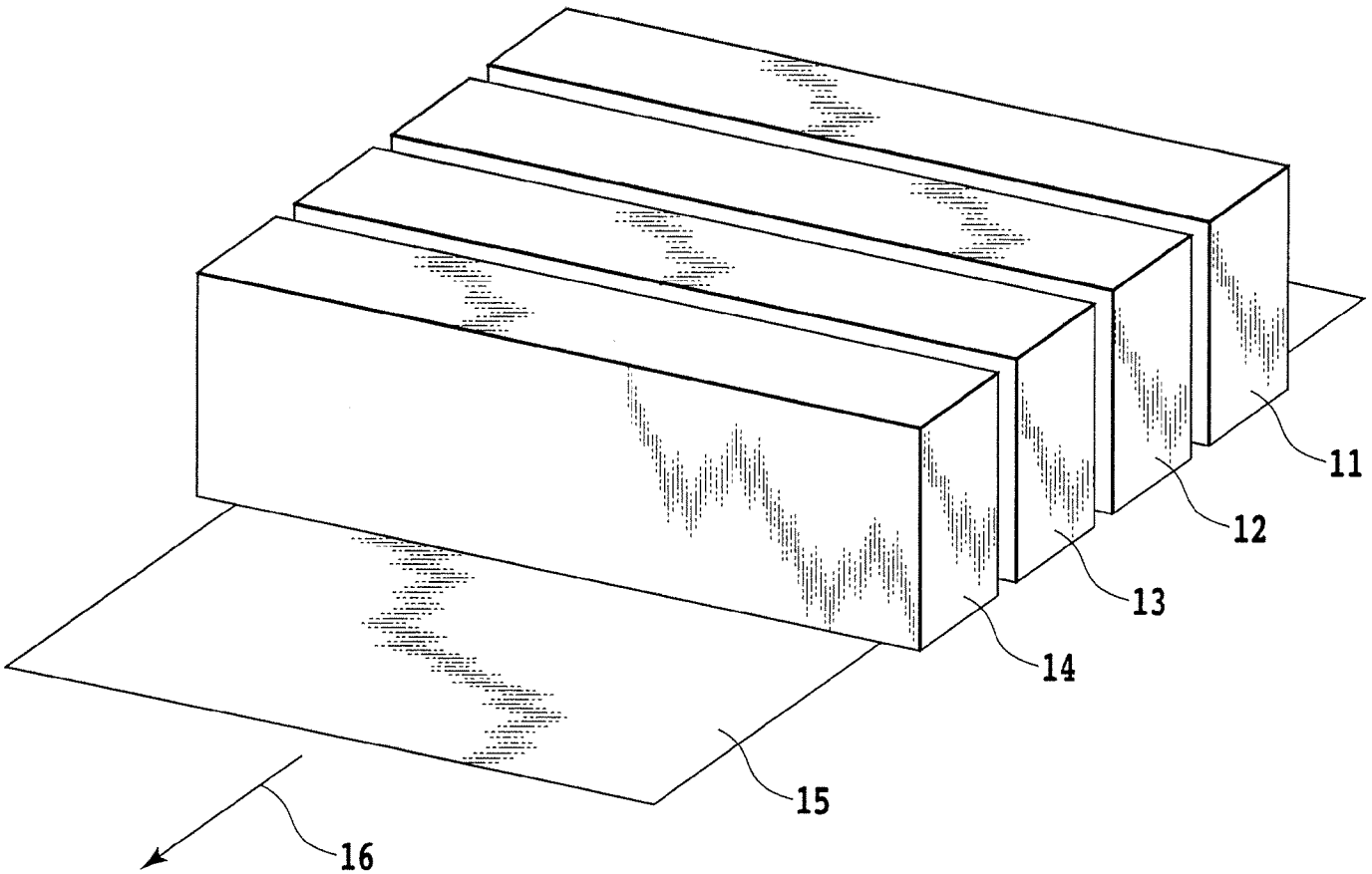
FIG. 15 is a view showing schematically an ink jet recording apparatus according to the first to the third preferred embodiments of the present invention.

FIG. 15 is a view showing schematically the recording apparatus used in Embodiment 1 according to the present invention. A plurality of elongate print heads 11 to 14 form a head unit. Each of the print heads 11 to 14 is an away of a plurality of nozzles for ejecting ink. The print heads 11 to 14 are elongate print heads for ejecting ink of black (K), ink of cyan (C), ink of magenta (M), and ink of yellow (Y), respectively. Each of the print heads is connected to an ink supplying tube (not shown). Further, a control signal or the like is transmitted to each of the print heads over a flexible cable (not shown).

A recording medium 15 is supported by being sandwiched between transport rollers (not shown). The recording medium 15 may be plain paper, high grade paper, OHP transparencies, glossy paper, glossy film, postcards, or the like. The recording medium 15 is fed in an arrow direction 16 (the main scanning direction) as driven by a transport motor. A heat generating element (a heater) for generating thermal energy for ejecting ink is provided in an inside (a liquid path) of a nozzle of the ink jet heads 11 to 14. In time with reading taken by a linear encoder (not shown), the heater is energized based on a recording signal corresponding to the print data. Drops of ink are thereby ejected onto the recording medium to perform printing.

The print head uses capping means (not shown) to seal a nozzle forming surface when recording is not done. The capping means prevents ink from being firmly fixed as a result of an ink solvent having been vaporized and the nozzles from being blocked due to dust or other foreign objects sticking thereto.

A capping function of the capping means is also used for other purposes. Specifically, the capping function is used for idle or dummy ejection, in which ink is ejected toward a cap portion which is away from the nozzle. This is done to solve the problem of an ejection failure or clogging of a nozzle having a low recording frequency. The capping function is also used for a recovery operation performed for a nozzle that has developed an ejection failure. The recovery operation specifically sucks up ink from the defective nozzle by actuating a pump not shown with the cap in place. A blade or wiping member may also be disposed at an area adjacent to the cap portion, thereby enabling cleaning of the nozzle forming surface of the ink jet head.

The recording apparatus was driven such that each drop of ink was ejected at 4.0±0.5 pl. The commercially available ink for the ink jet printer BFJ900® was used for the ink containing a color material. The photo glossy paper (Professional Photo Paper PR-101L'®) for the exclusive use in ink jet recording apparatuses of a size good for the image size of the print data was prepared.

The print head and the printing method will further be detailed. As the driving speed, the ink drop ejection driving frequency was 8 kHz. Photo-grade image print data was prepared as the print data corresponding to the image to be printed. The size of the image was as follows.

<Image 1>

Photo-Grade Image: 108.25 mm×127.0 mm

Figure 16:
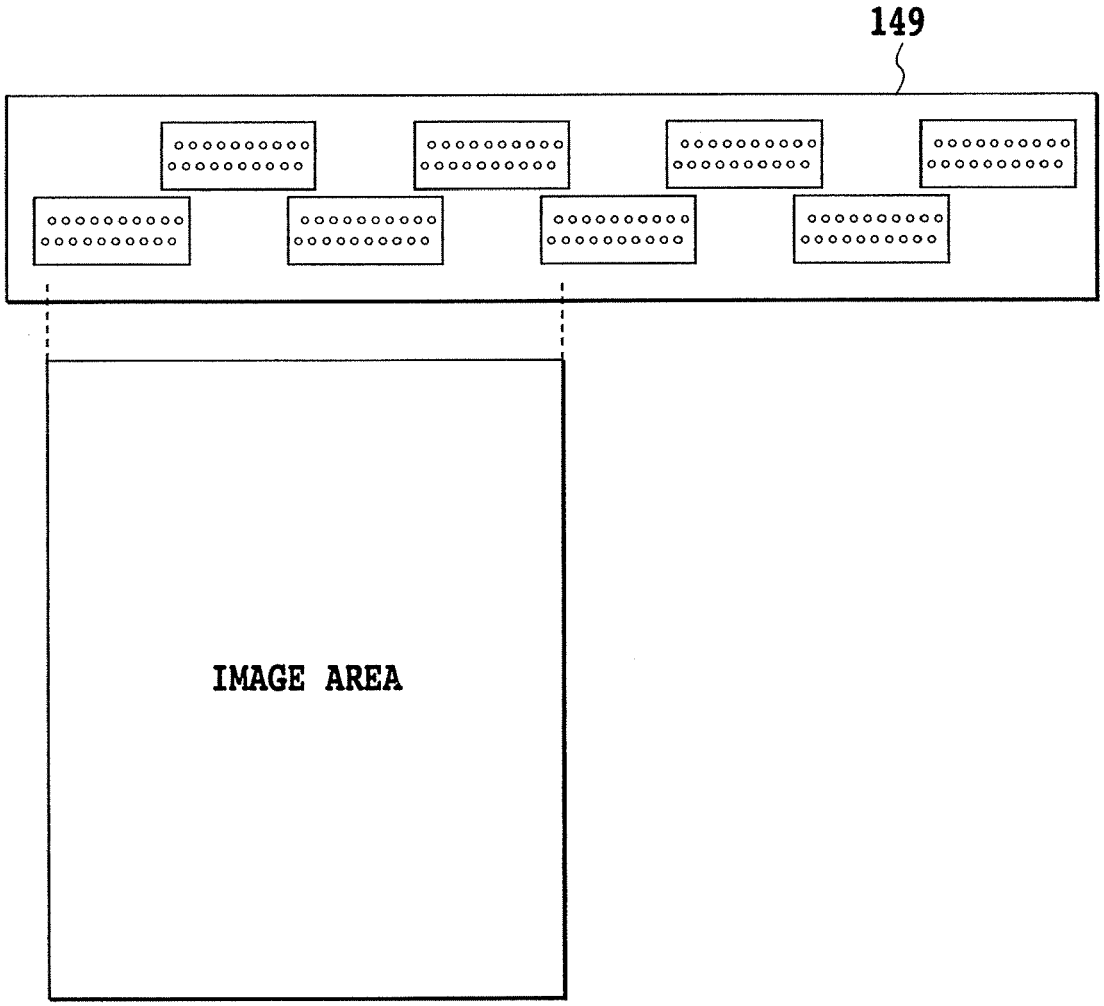
FIG. 16 is a view showing schematically an initial state of a relative relation between the print head and the print data image area according to the first preferred embodiment of the present invention.

Operations for actually printing Image 1 will next be described sequentially. The recording apparatus first reads the width of the print data (image size) corresponding to Image 1 and selects the groups of nozzles to be used. The width of the nozzles used for printing Image 1 is 5114 (=108.25 mm/25.4 mm×1200 dpi). The width figure is smaller than the total number of nozzles (10,226 nozzles) of the print head. FIG. 16 shows schematically a relative relation between the print head and the image area at this time.

The recording apparatus next selects the groups of nozzles required for printing from among the entire groups of nozzles. Specifically, the recording apparatus was set so that 5120(=5114 (width of the nozzles used)+6 (number of overlapping nozzles 2×number of Joints 3) nozzles as counted from the starting one were to be used. Further, the width of the nozzles used is 5114 (width of the nozzles used)=5120(width of the chip 1280×number of chips 4)−6 (number of overlapping nozzles 2×number of joints 3). The end of the image area coincides with the end of the overlapping nozzles of the chip joint. The recording apparatus therefore set, of the overlapping nozzles at the chip joint, to use continuously all nozzles included in the group of nozzles of a chip, of which nozzles other than the overlapping nozzles are used and selected the groups of nozzles that are not to be used.

Figure 17:
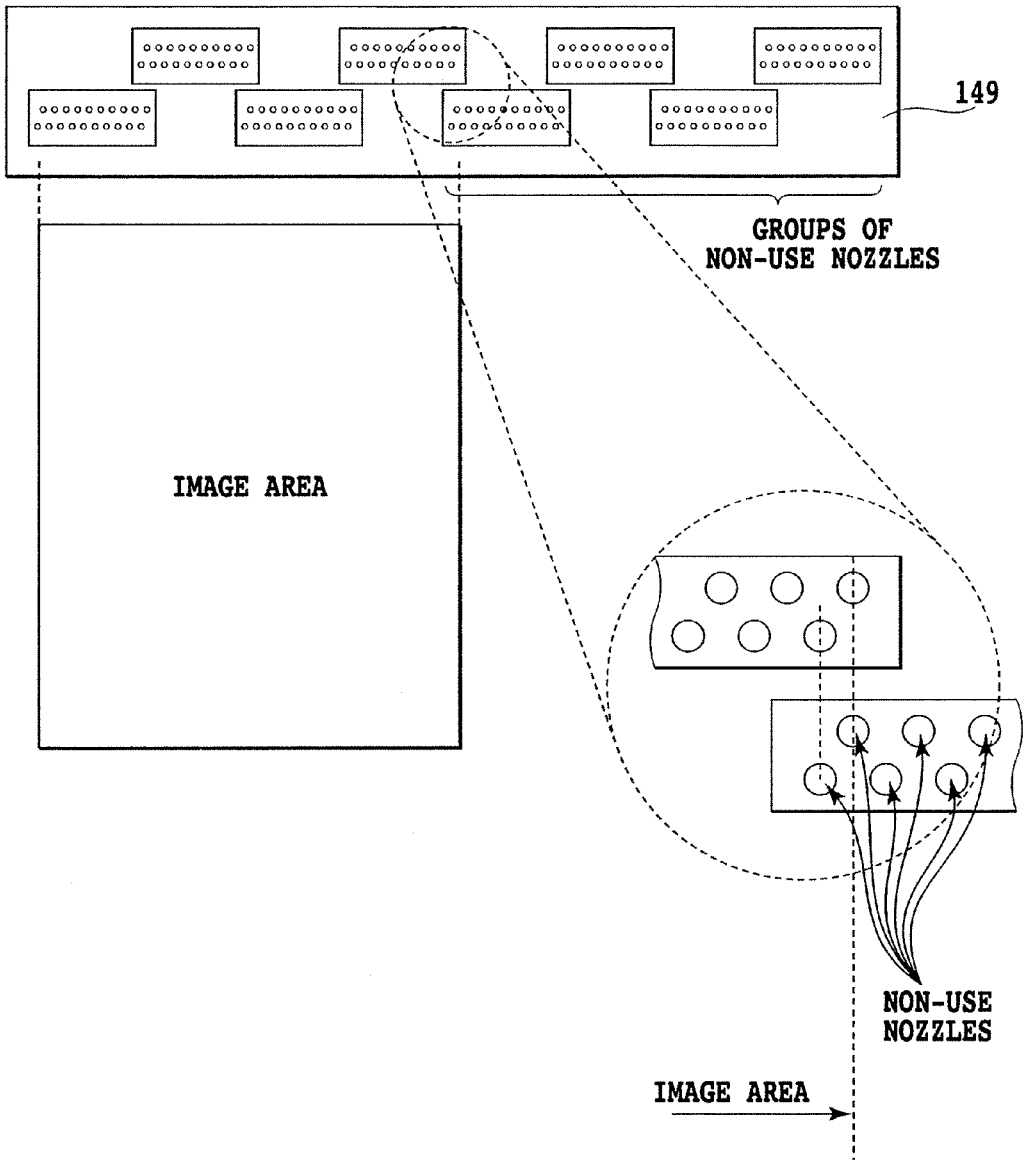
FIG. 17 is a view showing schematically a relative positional relation between the print head and the print data image area after the groups of nozzles used for printing have been determined according to the first preferred embodiment of the present invention.

The groups of nozzles to be used are accordingly determined and the relative positional relation between the print head and the recording medium is fixed as shown in FIG. 17. The recording apparatus transfers null print data so as to add a null part to the print data, thereby inhibiting the groups of nozzles not to be used from ejecting ink.

Under the conditions set as described in the foregoing, the recording apparatus carried out a print cycle through a single scanning action (what is commonly referred to as one pass) of Image 1. Then, the chip joint did not coincide with the end of the image area. The recording apparatus was accordingly able to produce a printed page of an image of satisfactory quality exhibiting no uneven streaks or uneven moiré, or other degraded quality.

EMBODIMENT 2

Embodiment 2 of the present invention using the ink jet recording apparatus explained in the foregoing with reference to the accompanying drawings will be described in detail. In each of the accompanying drawings, like parts are identified by the same reference numerals with explanations thereof being omitted.

A printed page was produced using the similar full multi-type print head and the similar recording apparatus as those used in Embodiment 1 and under exactly the same conditions as in Embodiment 1. The print head and the printing method will further be detailed. As the driving speed, the ink drop ejection driving frequency was 8 kHz. The size of the image of the print data was as follows.

<Image 2-1>

Photo-Grade Image: 108.28 mm×127.0 mm

Figure 18:
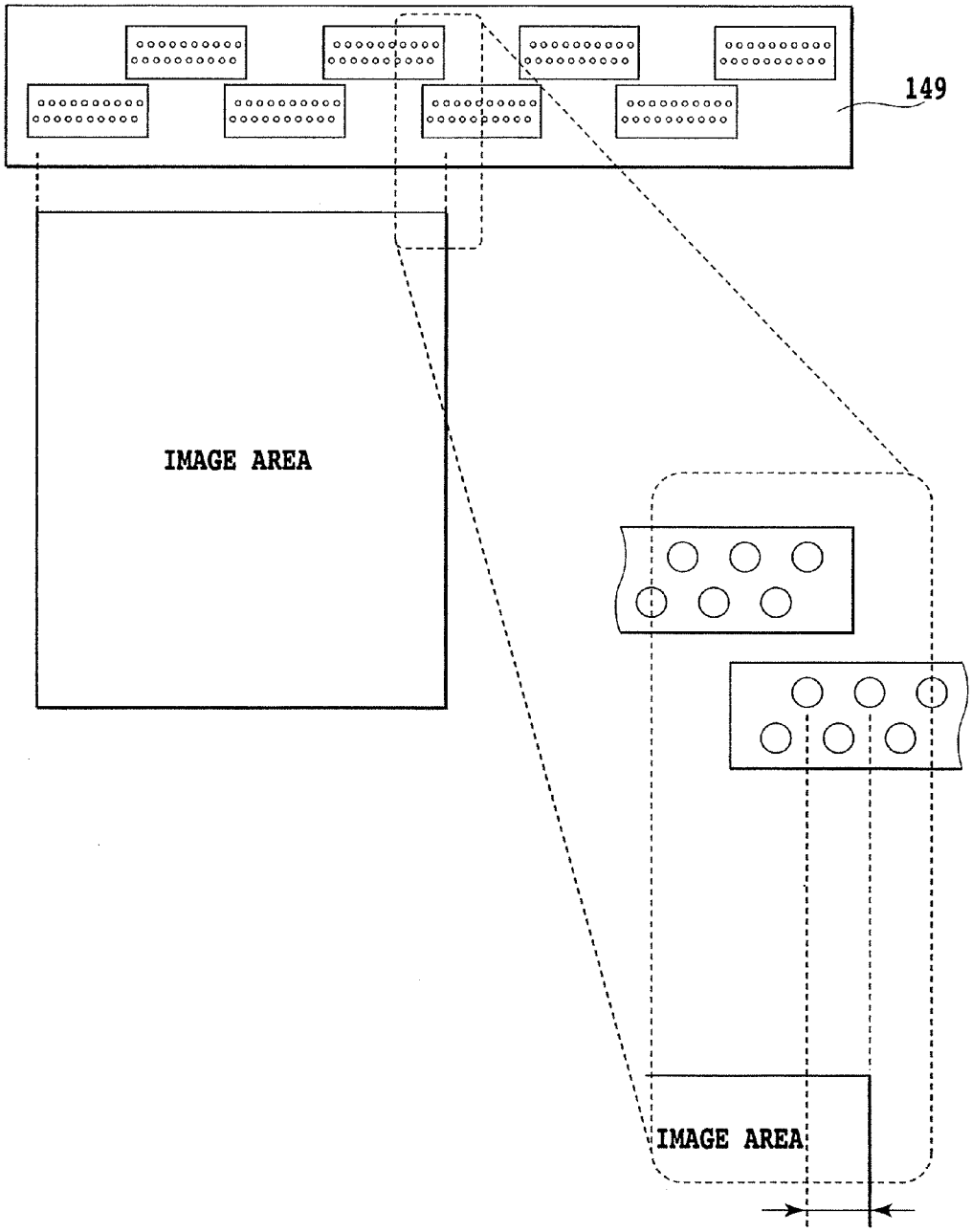
FIG. 18 is a view showing schematically an initial state of a relative relation between the print head and the print data image area according to the second preferred embodiment of the present invention.

Operations for actually printing Image 2-1 will next be described sequentially. The recording apparatus first reads the width of the print data (image size) corresponding to Image 2-1 and selects the groups of nozzles to be used. The width of the nozzles required for printing Image 2-1 is 5116(=108.28 mm/25.4 mm×1200 dpi). The width figure is smaller than the total number of nozzles (10,226 nozzles) of the print head. FIG. 18 shows schematically a relative relation between the print head and the image area at this time. As evident from FIG. 18, the end of the image area runs over the chip joint. The amount of the end of the image area running over the chip joint is equivalent to two nozzles, as obtained from the following formula: 5116 (required nozzle width)−5114(=5120(chip width 1280×number of chips 4)−6 (number of overlapping nozzles 2×number of joints 3)=2.

Figure 19:
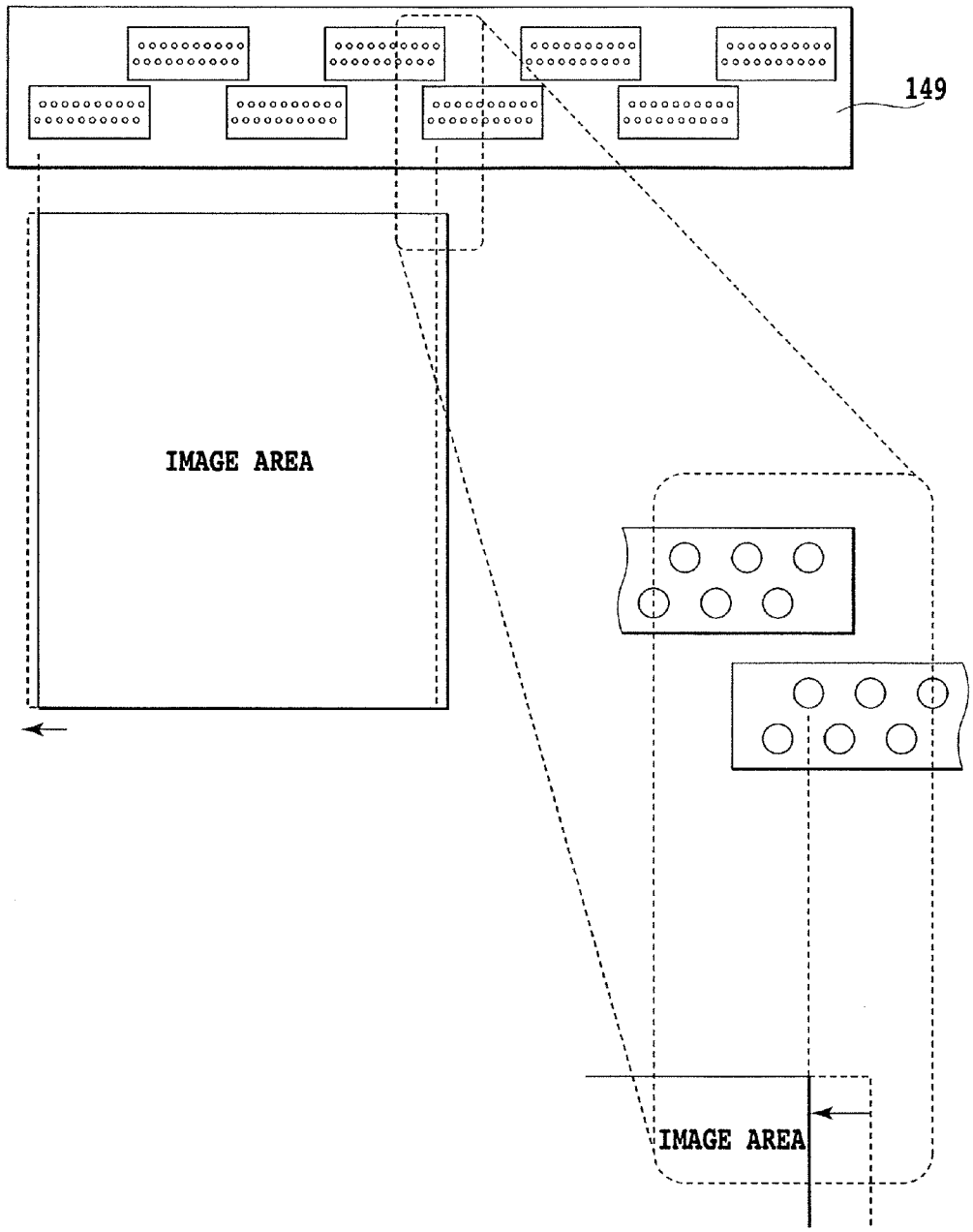
FIG. 19 is a view showing schematically a relative positional relation between the print head and the print data image area after the print data image has been shifted such that the area, in which the end of the print data image runs over the chip joint, falls within the chip joint according to the second preferred embodiment of the present invention.

The recording apparatus then adjusts so that the end of this running over area fits in the overlap of the chip joint. Specifically, the recording apparatus assigns print data for each nozzle by shifting the print data for two nozzles in the starting nozzle direction (FIG. 19). The recording apparatus further selects the groups of nozzles required for printing the shifted print data. Specifically, the recording apparatus sets so as to use 5120=5114(width of the nozzles used=5120 (chip width 1280×number of chips 4)−6 (number of overlapping nozzles 2×number of joints 3))+6 (number of overlapping nozzles 2×number of joints 3) nozzles as counted from the starting nozzle. Further, the end of the image area coincides with the overlapping nozzles of the chip joint. The recording apparatus therefore set, of the overlapping nozzles at the chip joint, to use continuously all nozzles included in the group of nozzles of a chip, of which nozzles other than the overlapping nozzles are used and selected the groups of nozzles that are not to be used.

Figure 20:
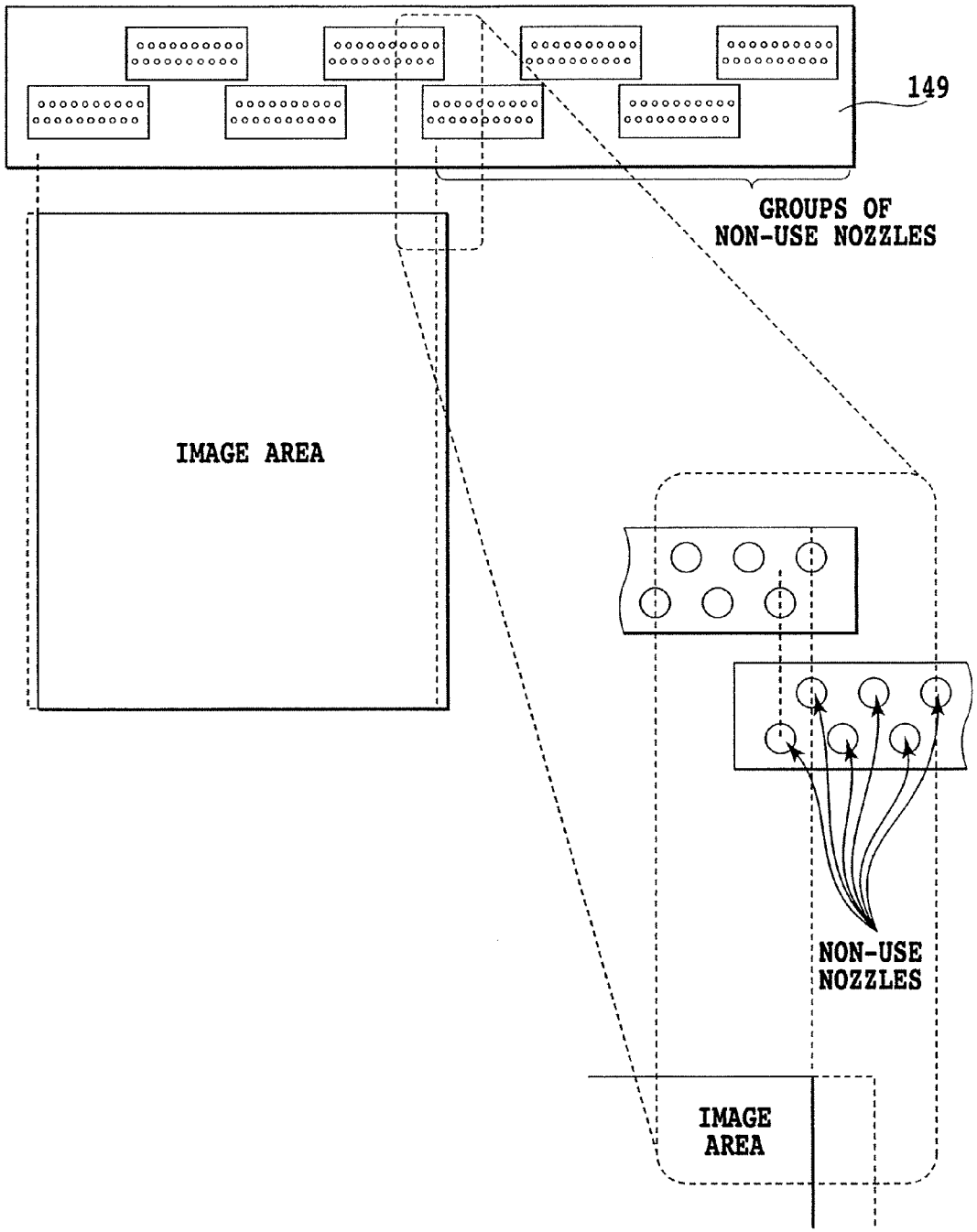
FIG. 20 is a view showing schematically a relative positional relation between the print head and the print data image area after the groups of nozzles used for printing have been determined according to the second preferred embodiment of the present invention.

The groups of nozzles to be used are accordingly determined and the relative positional relation between the print head and the recording medium is fixed as shown in FIG. 20. The recording apparatus transfers null print data so as to add a null part to the print data, thereby inhibiting the groups of nozzles not to be used from ejecting ink.

Under the conditions set as described in the foregoing, the recording apparatus carried out a print cycle through a single scanning action (what is commonly referred to as one pass) of Image 2-1. Then, the chip joint did not coincide with the end of the image area. The recording apparatus was accordingly able to produce a printed page of an image of satisfactory quality exhibiting no uneven streaks or uneven moiré, or other degraded quality.

The printing method for printing another image using the ink jet recording apparatus according to Embodiment 2 will be detailed. A graphic-grade image containing both text and graphics was prepared as the image to be printed. The size of the image of the print data was as follows.

<Image 2-2>

Graphic-Grade Image: 111.0 mm×127.0 mm

Herein, a margin of 2.0 mm (=2.0/25.4 mm×1200 dpi=for 95 nozzles) each is provided on surrounding sides of the image of the print data.

Figure 21:
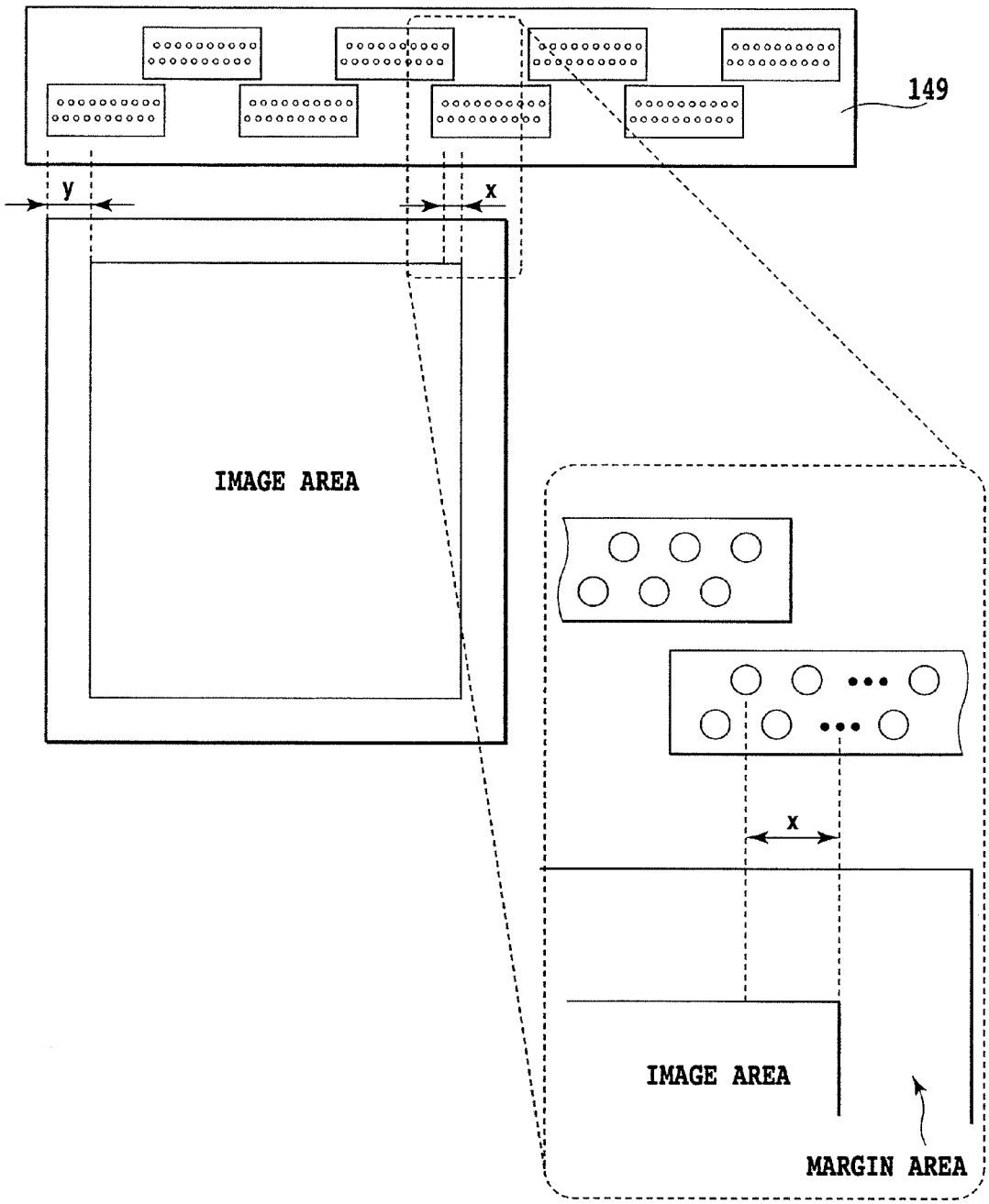
FIG. 21 is another typical view showing schematically the initial state of the relative relation between the print head and the print data image area according to the second preferred embodiment of the present invention.

Operations for actually printing Image 2-2 will next be described sequentially. The recording apparatus first reads the width of the print data (image size) corresponding to Image 2-2 and selects the groups of nozzles to be used. The width of the nozzles used for printing Image 2-2 is 5150 (=109.0/25.4 mm×1200 dpi) from the following observation. Specifically, the actual image area is 109.0 mm (=111.0−2.0) based on the area excluding the margin on a trailing end (e.g., the left end of the image in FIG. 21 or the like). This width figure is smaller than the total number of nozzles (10,226 nozzles) of the print head. FIG. 21 shows schematically a relative relation between the print head and the image area at this time. As evident from FIG. 21, the right end of the image runs over the chip joint. The amount of the end of the image area running over the chip joint x was equivalent to 38 nozzles.

Figure 22:
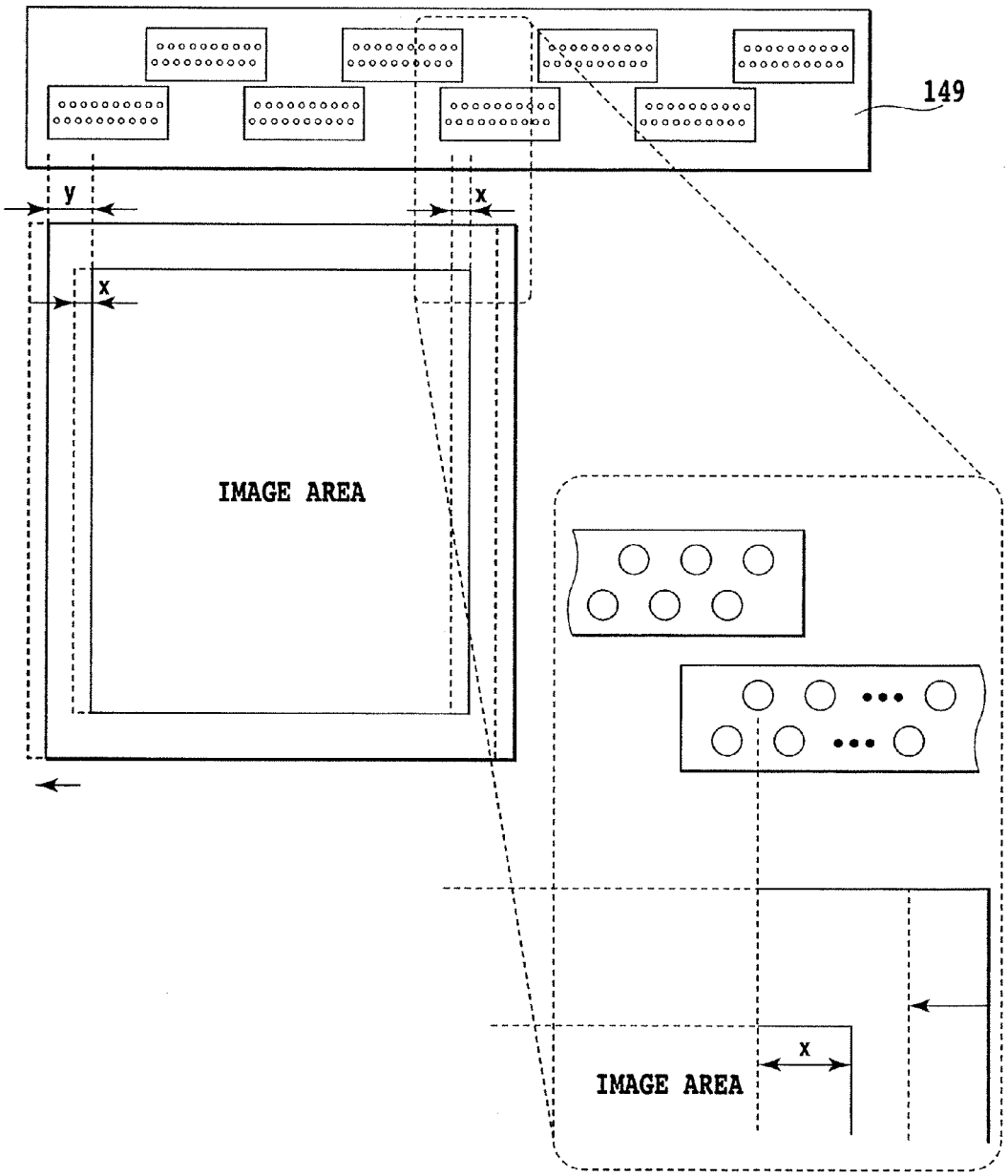
FIG. 22 is another typical view showing schematically the relative positional relation between the print head and the print data image area after the print data image has been shifted such that the area, in which the end of the print data image runs over the chip joint, falls within the chip joint according to the second preferred embodiment of the present invention.

The recording apparatus then determines whether or not the end of this running over area fits in the overlap of the chip joint. A non-ejection portion corresponding to what is called the margin area is provided in advance on a leading end of the image of the print data (y=2.0 mm=for 95 nozzles). Thus, since x≦y, the running over amount for 38 nozzles can be adjusted. Therefore, as shown in FIG. 22, the recording apparatus actually assigns print data for each nozzle by shifting the print data for x=38 nozzles in the starting nozzle direction (in the leftward direction in FIG. 22).

The recording apparatus further selects the groups of nozzles required for printing the shifted print data. Specifically, the recording apparatus set so as to use 5120=5114 (width of the nozzles used=5120(chip width 1280×number of chips 4)−6(number of overlapping nozzles 2×number of joints 3))+6 (number of overlapping nozzles 2×number of joints 3) nozzles as counted from the starting nozzle. The recording apparatus selected the groups of the nozzles used so that the groups of nozzles falling on the margin on the left end in FIG. 22 were not to be used. Further, the end of the image area coincides with the overlapping nozzles of the chip joint. The recording apparatus therefore set, of the overlapping nozzles at the chip joint, to use continuously all nozzles included in the group of nozzles of a chip, of which nozzles other than the overlapping nozzles are used and selected the groups of nozzles that are not to be used.

Figure 23:
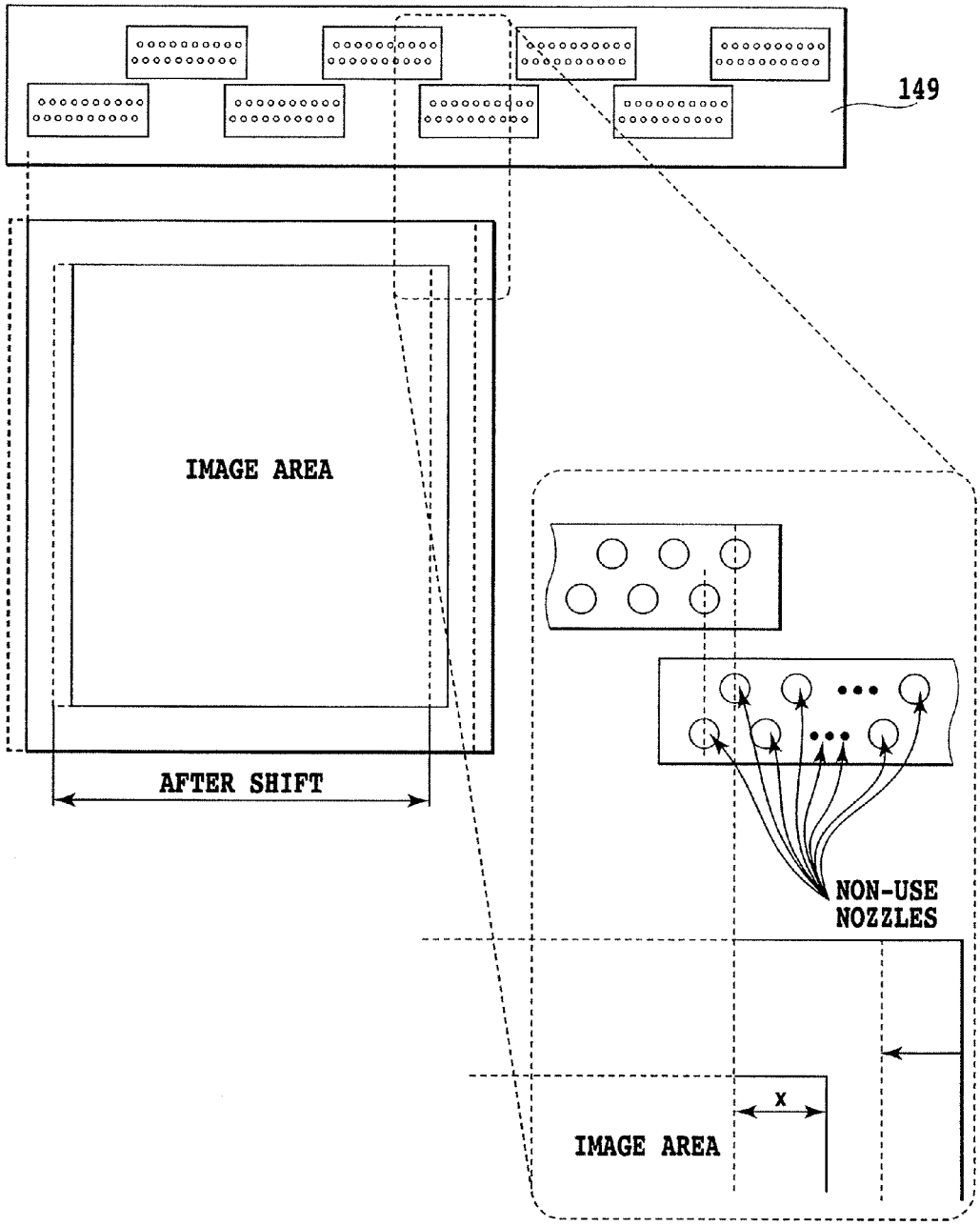
FIG. 23 is another typical view showing schematically the relative positional relation between the print head and the print data image area after the groups of nozzles used for printing have been determined according to the second preferred embodiment of the present invention.

The groups of nozzles to be used are accordingly determined and the relative positional relation between the print head and the recording medium is fixed as shown in FIG. 23. The recording apparatus transfers null print data so as to add a null part to the print data, thereby inhibiting the groups of nozzles not to be used from ejecting ink during printing.

Under the conditions set as described in the foregoing, the recording apparatus carried out a print cycle through a single scanning action (what is commonly referred to as one pass) of Image 2-2. Then, the chip joint did not coincide with the end of the image area. The recording apparatus was accordingly able to produce a printed page of an image of satisfactory quality exhibiting no uneven streaks or uneven moiré, or other degraded quality.

EMBODIMENT 3

Comparative Example

To ascertain effects in the aforementioned Embodiments 1 and 2, a comparative printed page was produced using the similar full multi-type print head and the similar recording apparatus as those used in Embodiment 1 and under the exactly the same conditions as in Embodiment 1. The print head and the printing method will further be detailed. As the driving speed, the ink drop ejection driving frequency was 8 kHz. The size of the image of the print data was as follows.

<Image 3>

Photo-Grade Image: 108.25 mm×127.0 mm

Operations for actually printing Image 3 will next be described sequentially. The recording apparatus first reads the width of the print data (image size) corresponding to Image 3 and selects the groups of nozzles to be used. The width of the nozzles required for printing Image 3 is 5114(=108.25 mm/25.4 mm×1200 dpi). The width figure is smaller than the total number of nozzles (10,226 nozzles) of the print head.

Figure 24:
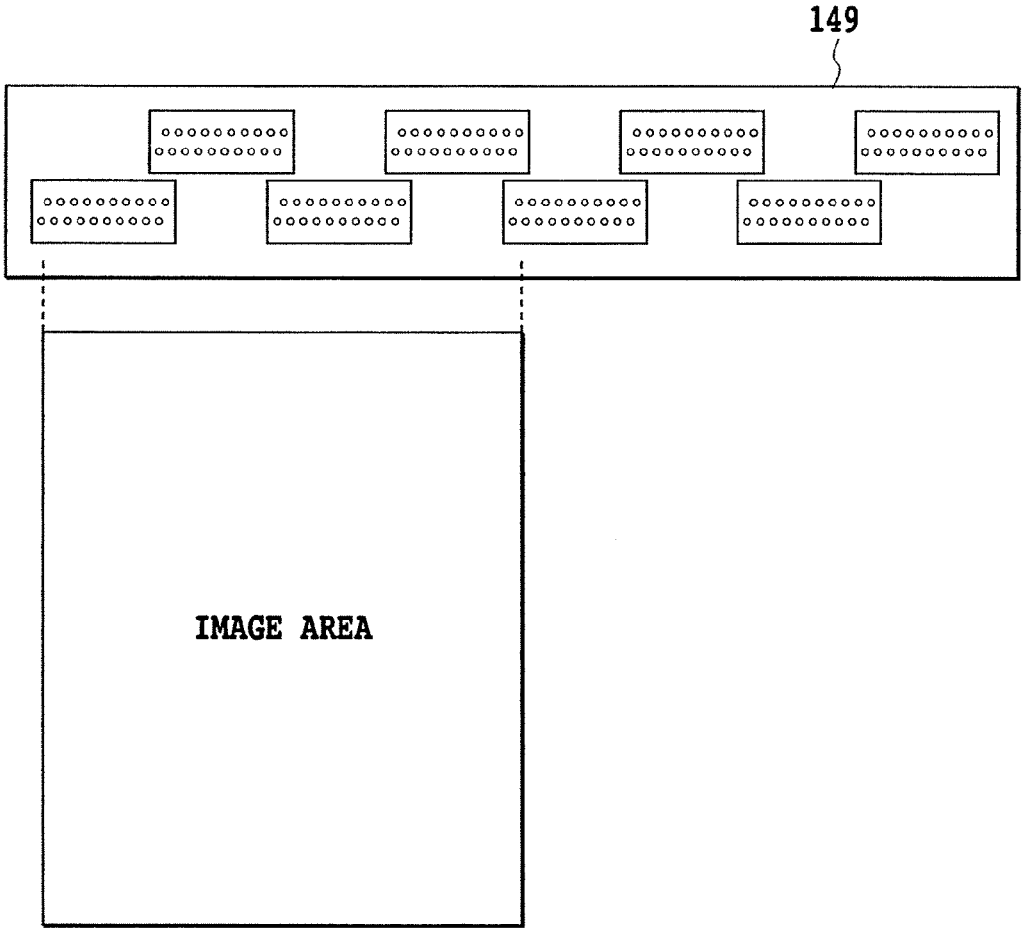
FIG. 24 is a view showing schematically an initial state of a relative relation between the print head and the print data image area according to the third preferred embodiment of the present invention.

FIG. 24 shows schematically a relative relation between the print head and the image area at this time. Unlike the printer used in Embodiment 1, the recording apparatus used in Embodiment 3 is designed to use for printing groups of nozzles beginning with the starting group of nozzles sequentially. For the nozzles to be used, therefore, the recording apparatus set so as to use 5122=5114(width of the nozzles used)+8(number of overlapping nozzles 2×number of joints 4) nozzles as counted from the starting nozzle. These nozzles represent all nozzles disposed within the width of the nozzles required for the print area. The recording apparatus thus selected the groups of the nozzles so as to use both overlapping nozzles at the chip joint also for the end of the image area.

Figure 25:
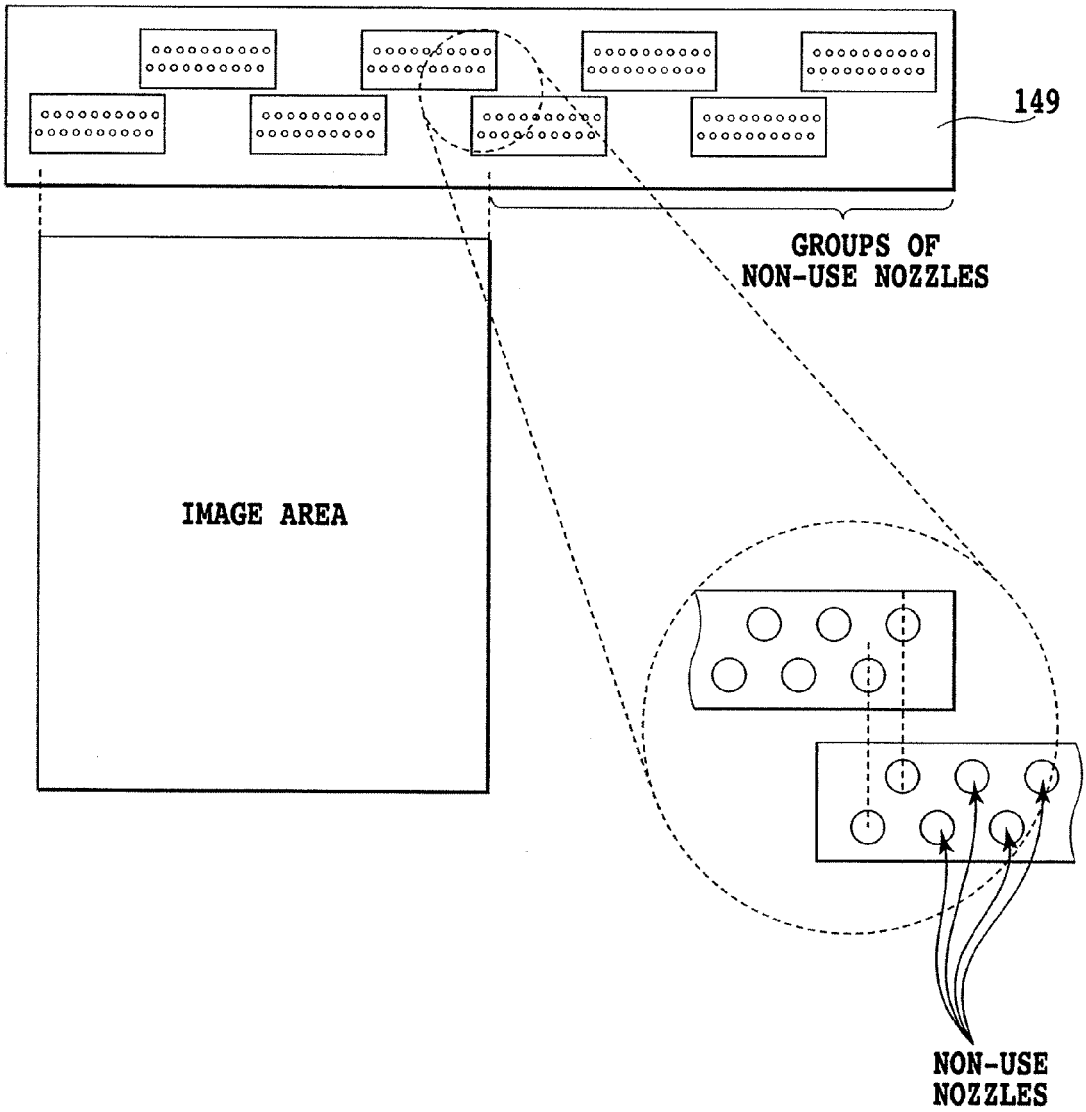
FIG. 25 is a view showing schematically a relative positional relation between the groups of nozzles used for printing and the recording medium according to the third preferred embodiment of the present invention

The relative positional relation between the print head and the recording medium at this time is as shown in FIG. 25. As in Embodiment 1, the recording apparatus transfers null print data so as to add a null part to the print data, thereby inhibiting the groups of nozzles not to be used from ejecting ink during printing. Under the conditions set as described in the foregoing, the recording apparatus carried out a print cycle through a single scanning action (what is commonly referred to as one pass) of Image 3. Noted in the printed page produced were uneven streaks or uneven moiré, or other degraded quality evident on the end of the print image.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2003-405129 filed Dec. 3, 2003, which is hereby incorporated by reference herein.

What is claimed is:

1. A recording apparatus having a print head formed by an array of a plurality of chips, each chip having a plurality of recording elements for recording an image arranged in a first direction, the print head being arranged in the first direction so as to have an overlap portion, in which adjacent chips overlap for a predetermined number of recording elements, and for recording, while transporting a recording medium in a second direction perpendicular to the first direction, an image to be recorded on the recording medium by driving the recording elements of the print head based on print data corresponding to the image to be recorded, comprising:

a first determination unit for determining whether or not an end of the image to be recorded is included in the overlap portion;

a first control unit for controlling, if a determination that the end is included in the overlap portion is made by the first determination unit, so as to use only one of the chips overlapping at the overlap portion for recording the image;

a second determination unit for determining whether or not the end of the image to be recorded runs over the overlap portion by a predetermined amount or less; and a second control unit for controlling, if a determination that the end of the image to be recorded runs over the overlap portion by the predetermined amount or less is made by the second determination unit, so as to use only one of the chips overlapping at the overlap portion for recording the image by correcting the print data such that the end of the image is included in the overlap portion.

2. The recording apparatus according to claim 1, wherein the predetermined amount is the number of recording elements corresponding to a width of a margin surrounding the image defined by the print data.

* * * * *

UNITED STATES PATENT AND TRADEMARK OFFICE

CERTIFICATE OF CORRECTION

PATENT NO. : 7,237,871 B2
APPLICATION NO. : 10/998649
DATED : July 3, 2007
INVENTOR(S) : Yamaguchi et al.

It is certified that error appears in the above-identified patent and that said Letters Patent is hereby corrected as shown below:

COLUMN 7:
Line 60, “away” should read --array--.

COLUMN 14:
Line 25, “away” should read --array--.

Signed and Sealed this

Tenth Day of March, 2009

JOHN DOLL
*Acting Director of the United States Patent and Trademark Office*